US010779653B2

(12) United States Patent
LaPointe et al.

(10) Patent No.: US 10,779,653 B2
(45) Date of Patent: Sep. 22, 2020

(54) FURNITURE MEMBER HAVING LEGREST MECHANISM

(71) Applicant: La-Z-Boy Incorporated, Monroe, MI (US)

(72) Inventors: Larry P. LaPointe, Temperance, MI (US); Michael R. Mero, Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 38 days.

(21) Appl. No.: 16/213,339

(22) Filed: Dec. 7, 2018

(65) Prior Publication Data

US 2019/0116981 A1 Apr. 25, 2019

Related U.S. Application Data

(63) Continuation-in-part of application No. PCT/US2017/043899, filed on Jul. 26, 2017, which is a continuation of application No. 15/272,825, filed on Sep. 22, 2016, now Pat. No. 9,986,835.

(51) Int. Cl.

| | |
|---|---|
| ***A47C 3/02*** | (2006.01) |
| ***A47C 3/025*** | (2006.01) |
| ***A47C 1/0355*** | (2013.01) |
| ***A47C 3/027*** | (2006.01) |

(52) U.S. Cl.
CPC ..... *A47C 3/0252* (2013.01); *A47C 1/0355* (2013.01); *A47C 3/027* (2013.01)

(58) Field of Classification Search
CPC ..... A47C 1/032; A47C 1/034; A47C 1/0342; A47C 1/02; A47C 1/024; A47C 1/0355; A47C 1/03205; A47C 1/03294; A47C 3/02; A47C 3/03; A47C 3/0252; A47C 7/40; A47C 7/54
USPC ..... 297/259.2, 258.1, 259.1, 260.3
See application file for complete search history.

(56) References Cited

U.S. PATENT DOCUMENTS

| | | | |
|---|---|---|---|
| 203,602 | A | 5/1878 | Dietsch |
| 1,182,854 | A | 5/1916 | Poler |
| 1,414,637 | A | 5/1922 | Gell |
| 2,473,895 | A | 6/1949 | Mednick |

(Continued)

FOREIGN PATENT DOCUMENTS

| | | | |
|---|---|---|---|
| CN | 200976974 | Y | 11/2007 |
| DE | 623960 | C | 1/1936 |

(Continued)

OTHER PUBLICATIONS

European Search Report for Application No. 19158581.9, dated May 3, 2019.

(Continued)

*Primary Examiner* — Mark R Wendell
(74) *Attorney, Agent, or Firm* — Harness, Dickey & Pierce, P.L.C.

(57) ABSTRACT

A furniture member may include a base frame and a seat assembly mounted on the base frame. The seat assembly may include a seat frame, a seatback, a seat bottom, and a legrest mechanism. The legrest mechanism may be mounted to the seat frame and attached to a legrest platform. The legrest mechanism may include a drive rod coupled to a pantograph linkage that is movable relative to the seat frame between retracted and extended positions.

18 Claims, 24 Drawing Sheets

(56) References Cited

U.S. PATENT DOCUMENTS 2,677,412 A 5/1954 Thomas
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,099,776 A 7/1978 Crum
4,140,342 A 2/1979 Jones
4,179,157 A 12/1979 Shoemaker et al.
4,212,494 A 7/1980 Dabney
4,216,991 A 8/1980 Holobaugh
4,216,992 A 8/1980 Crum
4,226,468 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,861,101 A 8/1989 Hartline
4,895,411 A * 1/1990 Pine ..... A47C 1/0345 297/68
4,932,927 A 6/1990 Fillar
4,989,914 A 2/1991 Pine
5,011,220 A 4/1991 LaPointe
5,044,692 A 9/1991 Tidwell, Jr. et al.
5,054,850 A * 10/1991 Pine ..... A47C 1/0345 297/68
5,064,244 A 11/1991 Sproule
5,072,988 A 12/1991 Plunk
5,088,789 A 2/1992 LaPointe et al.
5,123,705 A 6/1992 Johnson
5,129,701 A * 7/1992 Pine ..... A47C 1/0355 297/68
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,328,235 A 7/1994 Saul et al.
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A 1/1996 Sproule
5,503,453 A * 4/1996 Saul ..... A47C 1/0345 297/89
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A * 12/1996 Komorowski ..... A47C 1/0345 297/423.35
5,597,209 A 1/1997 Bart et al.
5,664,832 A 9/1997 Stevens et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,857,739 A 1/1999 Smith
5,865,457 A * 2/1999 Knabusch ..... A61G 5/006 280/304.1
5,954,392 A 9/1999 Liss et al.
5,971,475 A 10/1999 Lawson
5,975,627 A 11/1999 LaPointe et al.
6,000,754 A 12/1999 Lawson
6,179,328 B1 1/2001 Kawagoe et al.
6,309,015 B1 10/2001 Pine
6,330,995 B1 12/2001 Mangeiga et al.
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,988,769 B2 1/2006 LaPointe
7,261,367 B2 8/2007 Duncan et al.
7,275,789 B2 10/2007 LaPointe
7,338,132 B2 3/2008 LaPointe
7,357,450 B2 4/2008 Rogers
7,431,387 B2 10/2008 LaPointe et al.
7,475,944 B2 1/2009 Griepentrog et al.
7,637,571 B2 12/2009 Okano et al.
7,673,933 B2 3/2010 Lawson
7,731,276 B2 6/2010 Hoffman et al.
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,986,832 B2 6/2018 LaPointe et al.
9,986,835 B2 6/2018 LaPointe et al.
10,092,106 B2 10/2018 LaPointe et al.
2001/0026088 A1 10/2001 Robinson
2003/0057743 A1 3/2003 May
2004/0000803 A1 1/2004 Guillot et al.
2005/0067867 A1 3/2005 May
2006/0061147 A1 3/2006 Johnson
2006/0103202 A1 5/2006 Maki et al.
2006/0249992 A1 11/2006 LaPointe et al.
2006/0249993 A1 11/2006 Rogers
2007/0040419 A1 2/2007 LaPointe et al.
2007/0085395 A1 4/2007 LaPointe
2007/0241589 A1 10/2007 LaPointe
2008/0129006 A1 6/2008 Johnson et al.
2008/0150329 A1 6/2008 Lawson
2009/0284054 A1 11/2009 Humer et al.
2011/0016627 A1 1/2011 Blevins et al.
2011/0175426 A1 7/2011 Lawson
2011/0233972 A1 9/2011 Weicek
2011/0248544 A1 10/2011 Adams et al.
2011/0248547 A1 10/2011 LaPointe et al.
2011/0304193 A1 12/2011 Murphy et al.
2012/0193946 A1 8/2012 Robertson
2013/0062914 A1 3/2013 Marshall et al.
2013/0140855 A1 6/2013 Murphy et al.
2013/0175847 A1 7/2013 Lawson
2014/0049079 A1 2/2014 Lawson et al.

(56) References Cited

U.S. PATENT DOCUMENTS

| | | | |
|---|---|---|---|
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0312660 | A1 | 10/2014 | Natuzzi et al. |
| 2014/0333099 | A1 | 11/2014 | Lu et al. |
| 2014/0368011 | A1 | 12/2014 | LaPointe |
| 2015/0196123 | A1 | 7/2015 | Buehrer |
| 2015/0250320 | A1 | 9/2015 | Arceci et al. |
| 2015/0272329 | A1 | 10/2015 | Lawson |
| 2015/0282619 | A1 | 10/2015 | Lawson |
| 2016/0058195 | A1 | 3/2016 | Huang et al. |
| 2016/0100687 | A1 | 4/2016 | Murphy |
| 2016/0302573 | A1 | 10/2016 | Garland et al. |
| 2016/0325838 | A1 | 11/2016 | Erhel |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0206644 | A1 | 7/2018 | Murphy |
| 2018/0228290 | A1 | 8/2018 | Kiwak et al. |
| 2018/0289156 | A1 | 10/2018 | Marshall et al. |
| 2018/0289157 | A1 | 10/2018 | Marshall et al. |
| 2018/0289158 | A1 | 10/2018 | Marshall et al. |
| 2019/0313796 | A1 | 10/2019 | LaPointe |
| 2019/0350362 | A1 | 11/2019 | LaPointe et al. |
| 2019/0350368 | A1 | 11/2019 | LaPointe et al. |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| JP | 3198305 | U | 6/2015 |
| KR | 1020060036132 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015066030 | A1 | 5/2015 |
| WO | WO-2017155069 | A1 | 9/2017 |

OTHER PUBLICATIONS

First Examination Report for New Zealand Application No. 738919, dated Mar. 14, 2019.
U.S. Appl. No. 16/414,157, filed May 16, 2019, Larry P. LaPointe et al.
International Search Report for Application No. PCT/US2019/021568, dated Jun. 20, 2019.
Written Opinion of the International Searching Authority for Application No. PCT/US2019/021568, dated Jun. 20, 2019.
U.S. Appl. No. 15/481,642, filed Apr. 7, 2017, Richard E. Marshall et al.
U.S. Appl. No. 15/815,301, filed Nov. 16, 2017, Larry P. LaPointe et al.
U.S. Appl. No. 15/815,363, filed Nov. 16, 2017, Richard E. Marshall et al.
U.S. Appl. No. 15/831,865, filed Dec. 5, 2017, Richard E. Marshall et al.
U.S. Appl. No. 15/954,164, filed Apr. 16, 2018, Larry P. LaPointe.
U.S. Appl. No. 15/983,486, filed May 18, 2018, Larry P. LaPointe et al.
International Search Report for Application No. PCT/US2006/031852, dated Jun. 17, 2008.
Written Opinion of the International Searching Authority for Application No. PCT/US2006/031852, dated Jun. 17, 2008.
International Search Report for Application No. PCT/US2014/019455, dated May 26, 2014.
Written Opinion of the International Searching Authority for Application No. PCT/US2014/019455, dated May 26, 2014.
International Search Report for Application No. PCT/US2016/021361, dated May 30, 2016.
Written Opinion of the International Searching Authority for Application No. PCT/US2016/021361, dated May 30, 2016.
International Search Report for Application No. PCT/US2016/032967, dated Aug. 19, 2016.
Written Opinion of the International Searching Authority for Application No. PCT/US2016/032967, dated Aug. 19, 2016.
International Search Report for Application No. PCT/US2017/035976, dated Aug. 25, 2017.
Written Opinion of the International Searching Authority for Application No. PCT/US2017/035976, dated Aug. 25, 2017.
International Search Report for Application No. PCT/US2017/043899, dated Nov. 8, 2017.
Written Opinion of the International Searching Authority for Application No. PCT/US2017/043899, dated Nov. 8, 2017.
International Search Report for Application No. PCT/US2018/025467, dated Jul. 17, 2018.
Written Opinion of the International Searching Authority for Application No. PCT/US2018/025467, dated Jul. 17, 2018.
European Search Report for Application No. 18159817.8, dated Sep. 26, 2018.
European Search Report for Application No. 16824840.9, dated Dec. 7, 2018.
International Search Report for Application No. PCT/US2019/064607, dated Mar. 26, 2020.
Written Opinion of the International Searching Authority for Application No. PCT/US2019/064607, dated Mar. 26, 2020.
U.S. Appl. No. 16/869,648, filed May 8, 2020, Larry P. LaPointe et al.

* cited by examiner

FURNITURE MEMBER HAVING LEGREST MECHANISM

CROSS-REFERENCE TO RELATED APPLICATIONS

This application is a continuation-in-part of International Application No. PCT/US2017/043899 filed on Jul. 26, 2017, which claims the benefit and priority of U.S. Utility application Ser. No. 15/272,825 filed on Sep. 22, 2016. The entire disclosures of the above applications are incorporated herein by reference.

FIELD

The present disclosure relates to a furniture member having a legrest mechanism.

BACKGROUND

This section provides background information related to the present disclosure and is not necessarily prior art.

Furniture members such as chairs, sofas, loveseats, sectionals, and the like can include a mechanism that allows an occupant of the furniture member to move a legrest panel or platform from a stowed or retracted position to a deployed or extended position to support the legs and/or feet of the occupant. Other furniture members include rocker assemblies that allow for one or more seat assemblies to rock between a rocked-back tilt position and a rocked-forward tilt position.

The present disclosure provides a furniture member having an extendable legrest. The furniture member of the present disclosure may also include a tilt mechanism that locks the seat assembly in a selected tilt position when the occupant moves the legrest out of the retracted position. This allows the occupant to select a position of the furniture member that provides optimal comfort for any given occupant on any given occasion.

SUMMARY

This section provides a general summary of the disclosure, and is not a comprehensive disclosure of its full scope or all of its features.

The present disclosure provides a furniture member that may include a base frame and a seat assembly mounted on the base frame. The seat assembly may include a seat frame, a seatback, a seat bottom, and a legrest mechanism. The seatback is mounted to the seat frame. The seat bottom is mounted to the seat frame. The legrest mechanism may be mounted to the seat frame and attached to a legrest platform. The legrest mechanism may include a drive rod coupled to a pantograph linkage that is movable relative to the seat frame between a retracted position and an extended position.

In some configurations, the furniture member includes a rocker member attached to the seat frame and in rolling contact with the base frame. The rocker member may support the seat assembly relative to the base frame such that the seat assembly is movable between a fully rocked-back tilt position and a fully rocked-forward tilt position.

In some configurations, the furniture member includes a tilt mechanism that selectively locks the seat assembly in one of an infinite number of tilt positions between the fully rocked-back tilt position and the fully rocked-forward tilt position.

In some configurations, the tilt mechanism includes a cam, a first link (e.g., a cam support link), a second link (e.g., a connecting link), and a cam follower. The cam may be coupled to the drive rod and the first link. The first link may be rotatably mounted to the base frame. The second link may be rotatably coupled to the first link and the seat frame. The cam follower may be rotatably coupled to the second link. The first and second links may rotate relative to the base frame and the seat frame as the seat assembly moves between the fully rocked-back and fully rocked-forward tilt positions.

In some configurations, rotation of the drive rod relative to the seat frame causes corresponding rotation of the cam about a first rotational axis extending through the cam and the first link between a locked position and an unlocked position. The cam may frictionally engage the cam follower in the locked position to lock the seat assembly in one of the infinite number of tilt positions between the fully rocked-back tilt position and the fully rocked-forward tilt position. The cam may be disengaged from the cam follower in the unlocked position.

In some configurations, the tilt mechanism includes a third link (e.g., an actuation link) operatively coupling the cam with the drive rod. The cam may be rotatable relative to the third link about a second rotational axis that extends through the cam and the third link.

In some configurations, the tilt mechanism includes a crank link coupling the drive rod with the third link.

In some configurations, the tilt mechanism includes a fourth link (e.g., a cam follower support link) coupled to the seat frame and rotatable relative to the first and second links. The cam follower may be rotatably attached to an end of the fourth link.

In some configurations, the tilt mechanism includes a first stop member that extends from the second link and limits a range of rotational motion of the fourth link relative to the second link.

In some configurations, the tilt mechanism includes a spring attached to the first stop member and the cam follower.

In some configurations, the tilt mechanism includes a cam follower runner extending outward from the cam follower and slidably engaging the cam when the cam is in the unlocked position. The cam follower runner may maintain a cam engagement surface of the cam follower spaced apart from the cam in the unlocked position.

In some configurations, the seat assembly includes a brace member extending from the drive rod to a front rail plate of the seat frame. The brace member may include a second stop member extending therefrom and further limiting the range of rotational motion of the fourth link relative to the second link.

In some configurations, the cam includes a convex cam surface that engages a concave cam engagement surface of the cam follower.

In some configurations, a friction pad is attached to a body of the cam follower and defines the concave cam engagement surface. The body of the cam follower may be formed from a first material, and the friction pad may be formed from a second material having a higher coefficient of friction than the first material.

In some configurations, the tilt mechanism includes a torsion spring attached to the cam and the first link and rotationally biasing the cam about a first rotational axis relative to the first link. The first rotational axis extends through the first link and the cam.

In some configurations, the legrest mechanism includes a mid-ottoman bracket non-rotatably attached to a link of the pantograph linkage. The mid-ottoman bracket is disposed between the seat bottom and the legrest platform when the pantograph linkage is in the extended position.

In some configurations, the mid-ottoman bracket is removably attached to the link of the pantograph linkage with a fastener (e.g., a threaded fastener, a rivet, etc.).

In some configurations, all of the links of the pantograph (except for a bracket link to which the legrest platform is attached) are flat (i.e., lacking offsets).

In some configurations, the seat assembly includes a front swing link having a first end pivotably coupled to a first bracket fixedly attached to the seat bottom and a second end pivotably coupled to a second bracket fixedly attached to a front rail plate of the seat frame.

In some configurations, the seatback is rotatable relative to the seat bottom between a reclined position and an upright position. Rotation of the seatback may cause rotation of the front swing link relative to the seat frame. Rotation of the front swing link relative to the seat frame may move the seat bottom forward or backward relative to the seat frame.

The present disclosure also provides a furniture member that may include a base frame, a seat frame, a rocker member, a legrest mechanism, and a tilt mechanism. The seat frame is mounted to the base frame. The rocker member is attached to the seat frame and is in rolling contact with the base frame. The rocker member supports the seat frame relative to the base frame such that the seat frame is movable between a fully rocked-back tilt position and a fully rocked-forward tilt position. The legrest mechanism is mounted to the seat frame and is attached to a legrest platform. The legrest mechanism may include a drive rod coupled to a pantograph linkage that is movable relative to the seat frame between a retracted position and an extended position. The tilt mechanism may include a cam and a cam follower. The drive rod may be drivingly coupled to the cam to move the cam relative to the cam follower between a locked position and an unlocked position. The cam may frictionally engage the cam follower in the locked position to lock the seat frame in one of an infinite number of tilt positions between the fully rocked-back tilt position and the fully rocked-forward tilt position. The cam may be disengaged from the cam follower in the unlocked position.

The present disclosure also provides a furniture member that may include a base frame, a seat frame, a seat bottom, a seatback, a front swing link, a rocker member, a legrest mechanism, and a tilt mechanism. The seat frame is mounted to the base frame. The seat bottom is mounted to the seat frame. The seatback is mounted to the seat frame. The seatback is rotatable relative to the seat bottom and the seat frame between a reclined position and an upright position. The front swing link includes a first end pivotably coupled to a first bracket fixedly attached to the seat bottom and a second end pivotably coupled to a second bracket fixedly attached to a front rail plate and/or a side rail plate of the seat frame. Rotation of the seatback between the reclined and upright positions may cause rotation of the front swing link relative to the seat frame. Rotation of the front swing link relative to the seat frame may move the seat bottom relative to the seat frame. The rocker member may be attached to the seat frame and is in rolling contact with the base frame. The rocker member supports the seat frame relative to the base frame such that the seat frame is movable between a fully rocked-back tilt position and a fully rocked-forward tilt position. The legrest mechanism is mounted to the seat frame and attached to a legrest platform. The legrest mechanism may include a drive rod coupled to a pantograph linkage that is movable relative to the seat frame between a retracted position and an extended position. The legrest mechanism may include a mid-ottoman bracket non-rotatably and removably attached to a link of the pantograph linkage. The mid-ottoman bracket may be disposed between the seat bottom and the legrest platform when the pantograph linkage is in the extended position. The tilt mechanism including a cam and a cam follower. The drive rod may be drivingly coupled to the cam to move the cam relative to the cam follower between a locked position and an unlocked position. The cam frictionally engages the cam follower in the locked position to lock the seat frame in one of an infinite number of tilt positions between the fully rocked-back tilt position and the fully rocked-forward tilt position. The cam may be disengaged from the cam follower in the unlocked position. In some configurations, a cam follower support link may move the center of a pivot of the cam follower to an over-center position relative to a pivot of the cam (e.g., a rotational axis of the cam extending through the cam and cam support links) to prevent disengagement of the cam follower from the cam during operational use.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
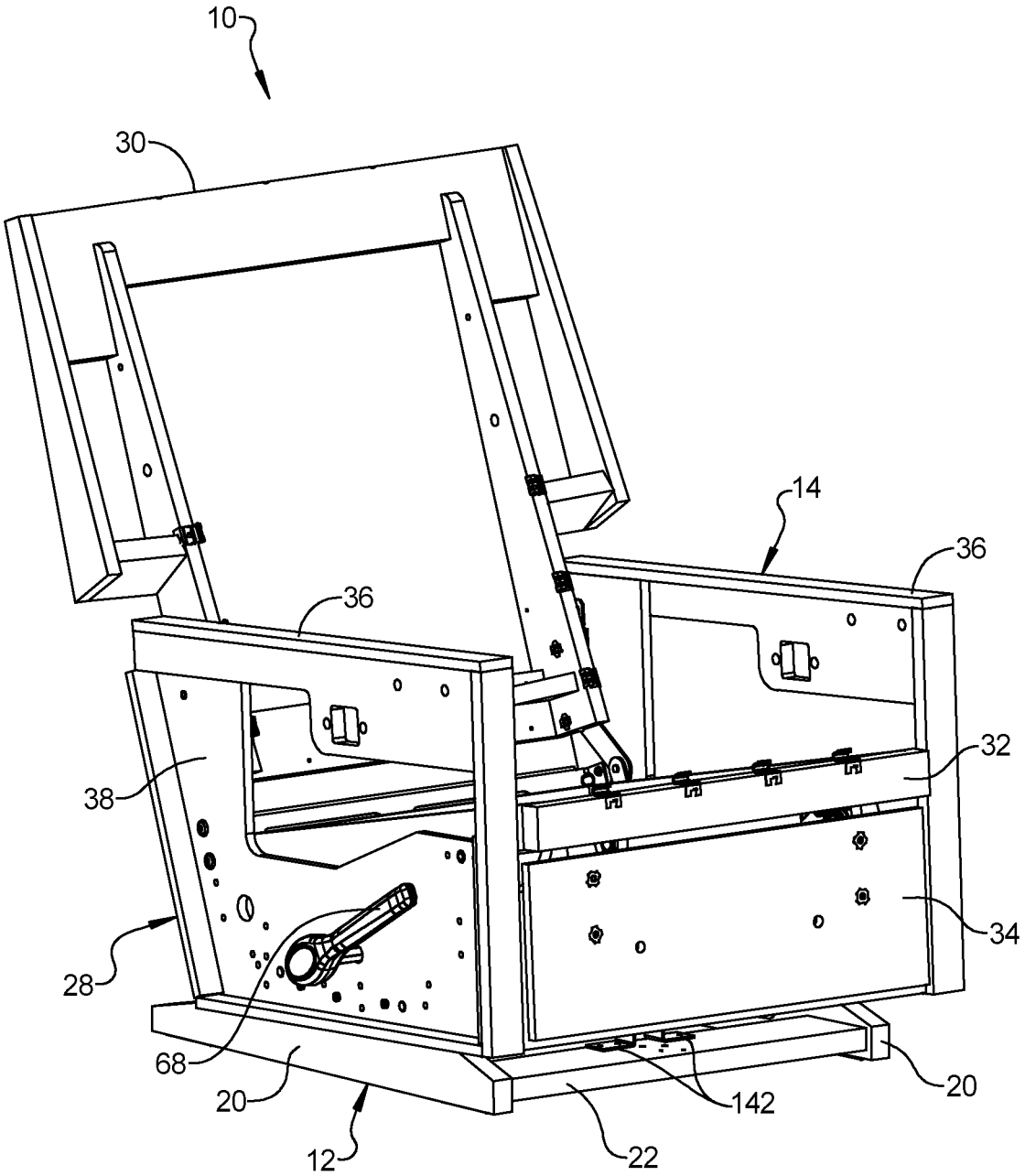
FIG. 1 is a perspective view of a furniture member having a tilt mechanism according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
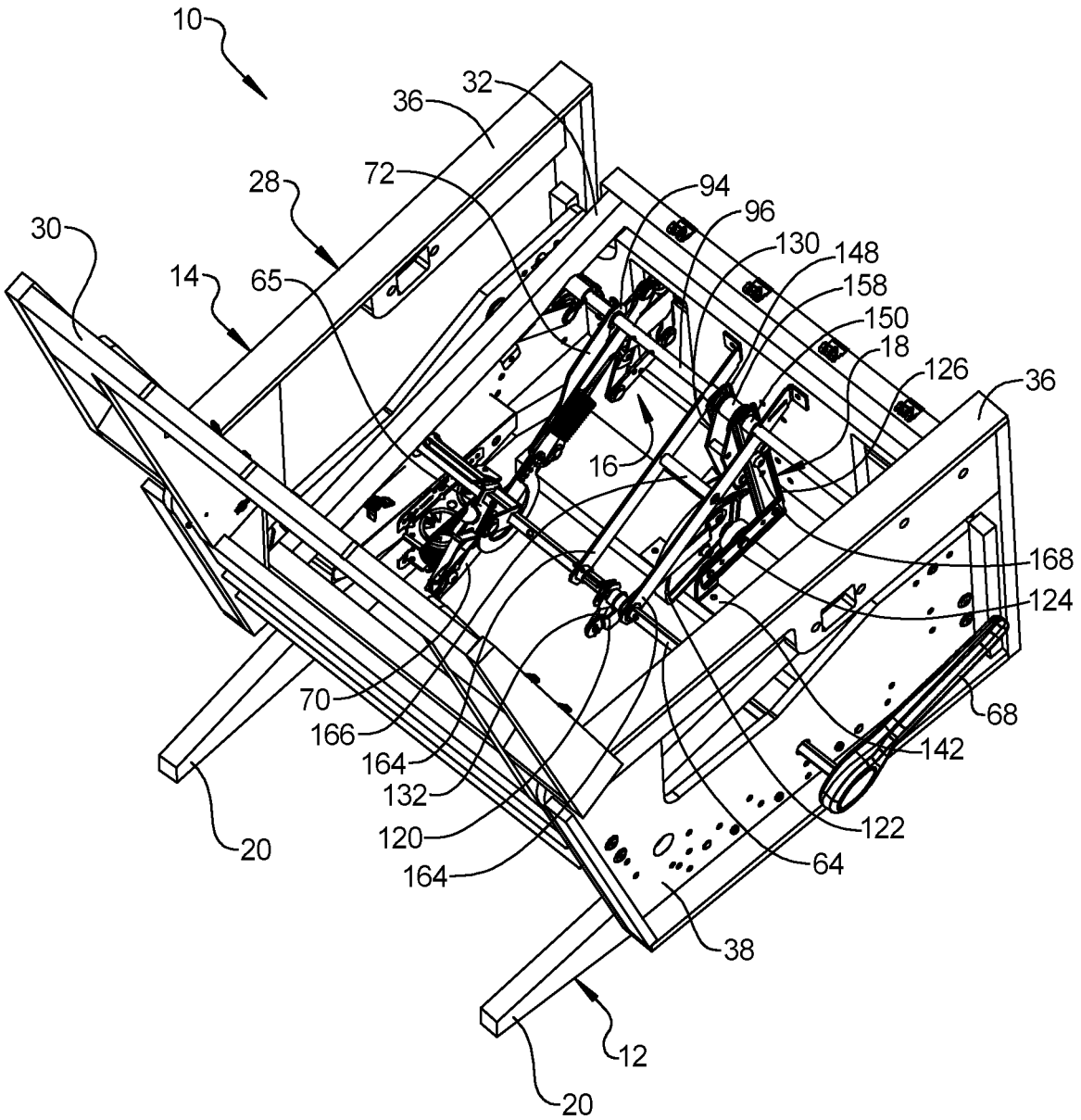
FIG. 2 is another perspective view of the furniture member.
Figure 12:
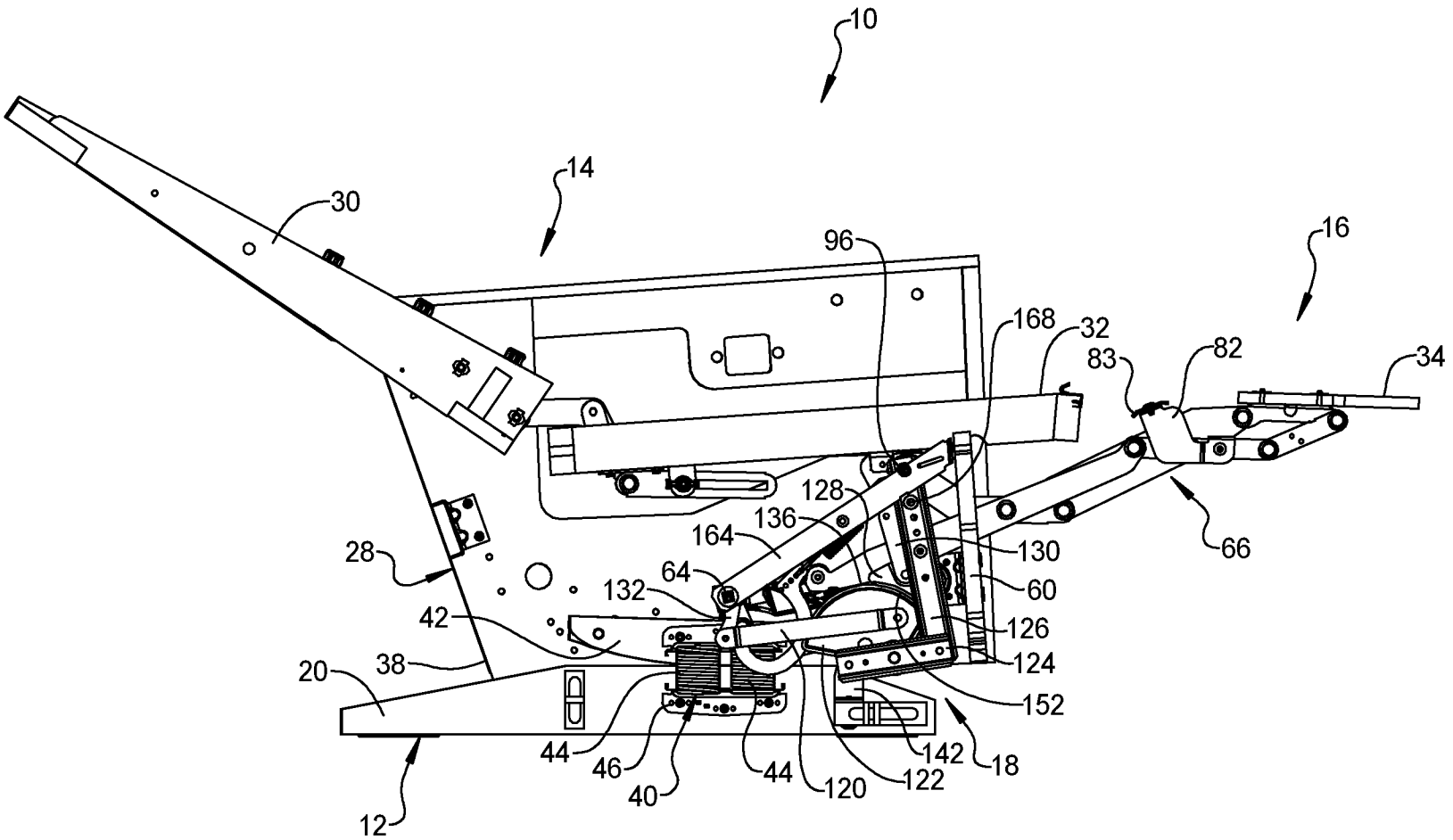
FIG. 12 is a side view of the furniture member positioned as shown in FIG. 11 with portions of the base frame and seat frame removed to more clearly show the tilt mechanism in a locked position.
Figure 13:
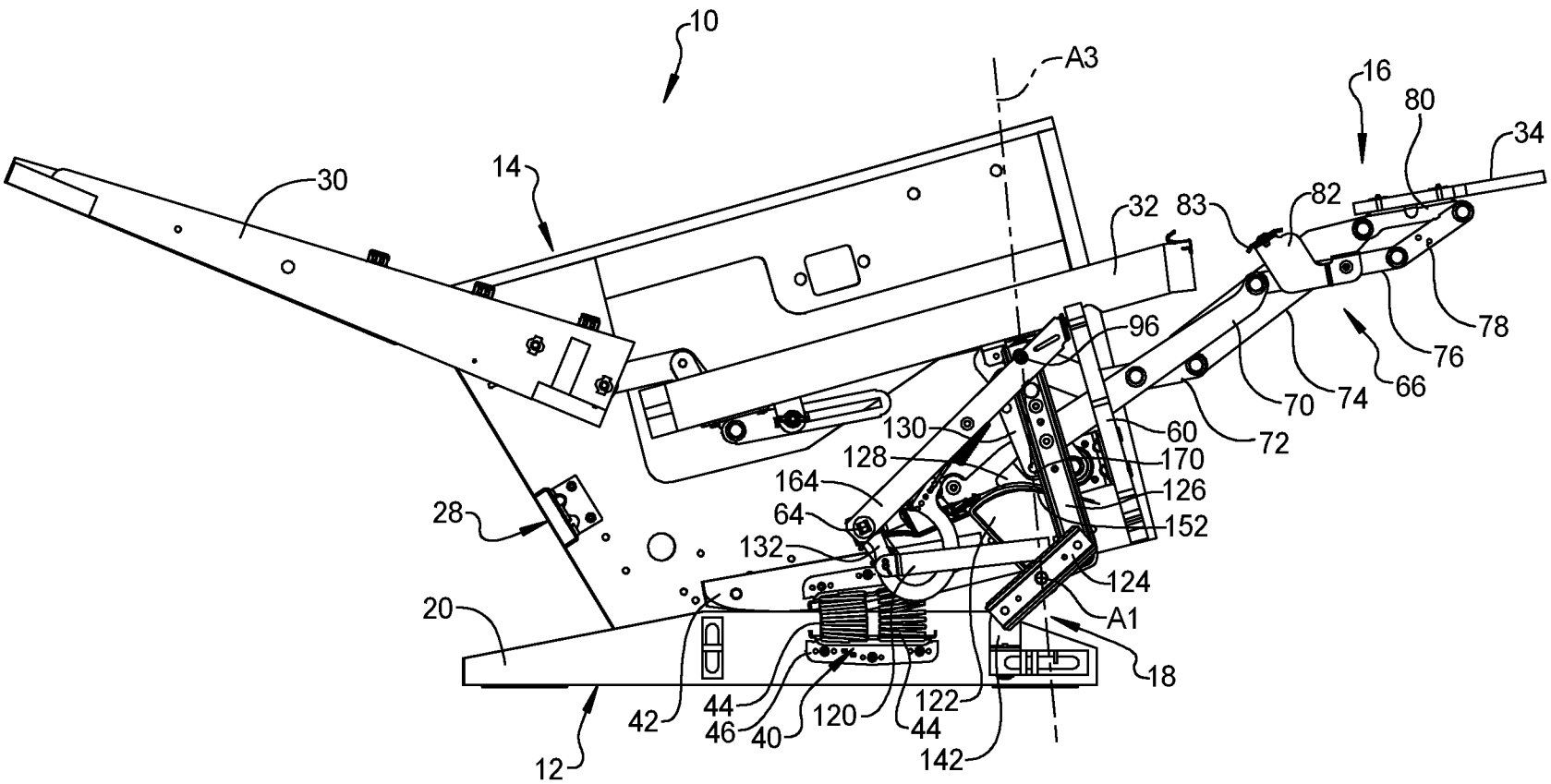
FIG. 13 is a side view of the furniture member in the rocked-back tilt position with the seatback in the reclined position and the legrest mechanism in the extended position and with portions of the base frame and seat frame removed to more clearly show the tilt mechanism in the locked position.
Figure 14:
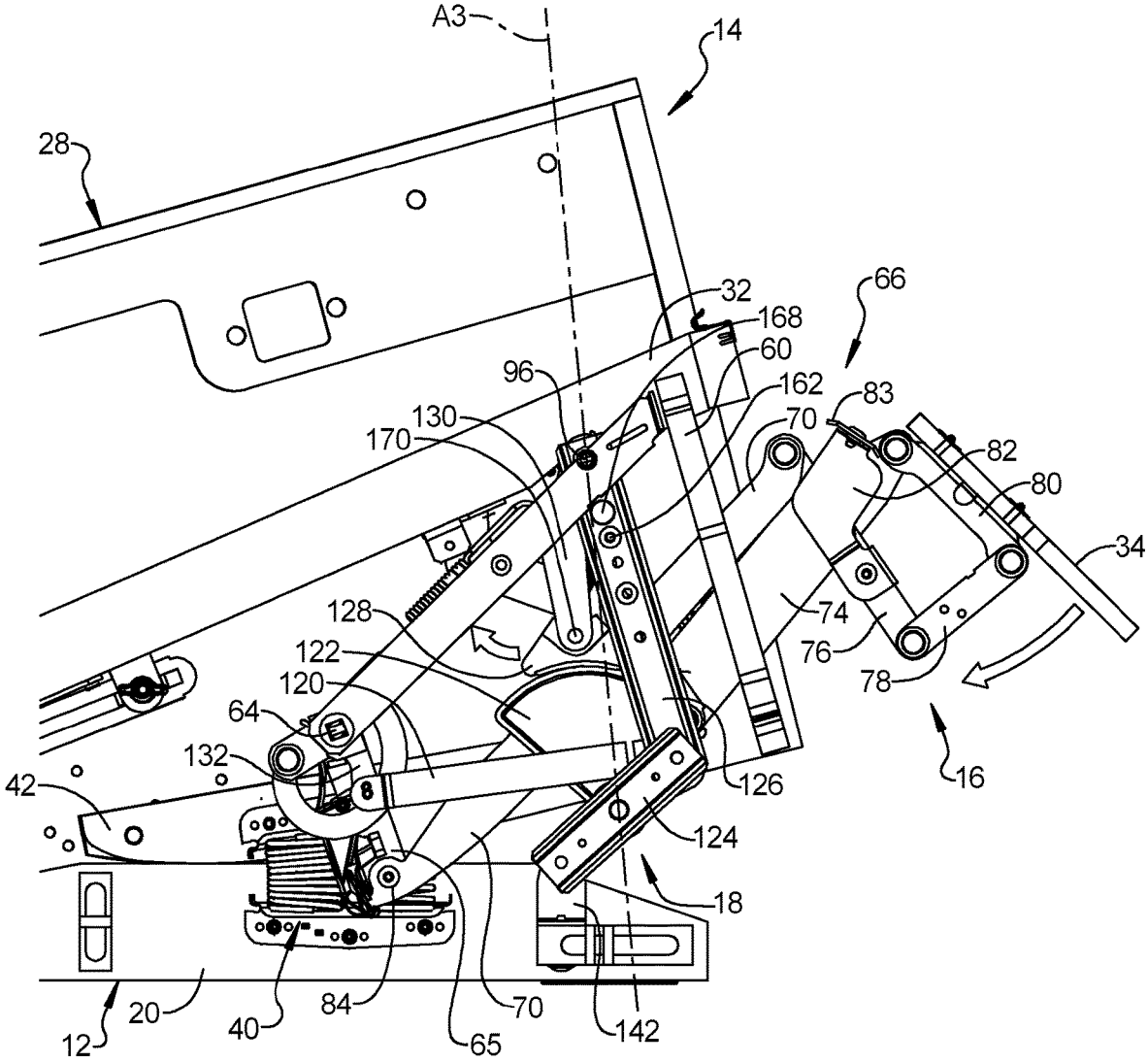
FIG. 14 is a partial side view of the furniture member with the legrest moving toward the retracted position and the tilt mechanism moving toward the unlocked position.

As shown in FIGS. 1 and 2, a furniture member 10 is provided that may include a base frame 12, a seat assembly 14, a legrest mechanism 16, and a tilt mechanism 18. As will be described in more detail below, the seat assembly 14 may be configured to rock relative to the base frame 12 among a nominal tilt position (FIGS. 3 and 4), a rocked-back tilt position (FIGS. 5 and 6), and a rocked-forward tilt position (FIGS. 7 and 8). The seat assembly 14 may be movable between a reclined position (FIGS. 16 and 17) and an upright position (FIGS. 18 and 19) while the furniture member 10 is in any of the nominal, rocked-back, and rocked-forward tilt positions (and in any tilt position between the rocked-back and rocked-forward tilt positions). Furthermore, the legrest mechanism 16 is movable between a retracted position (FIGS. 18 and 19) and an extended position (FIGS. 16 and 17) while the furniture member 10 is in any of the nominal, rocked-back and rocked-forward tilt positions (and in any tilt position between the rocked-back and rocked-forward tilt positions) and while the seat assembly 14 is in either of reclined and upright positions (or any position therebetween). As shown in FIGS. 12-14, when the legrest mechanism 16 is moved into the extended position (i.e., a fully extended position or a partially extended position), the tilt mechanism 18 locks the seat assembly 14 into a selected tilt position (i.e., the seat assembly 14 is prevented from rocking relative to the base frame 12). As the legrest mechanism 16 moves into the retracted position, the tilt mechanism 18 unlocks the seat assembly 14 relative to the base frame 12 to allow the seat assembly 14 to rock among the nominal, rocked-back, and rocked-forward tilt positions.

Referring now to FIGS. 1-8, the base frame 12 may include plurality of stationary beams including, for example, a pair of side support members 20 and a pair of cross members 22 (only one of which is shown in FIG. 1). The cross members 22 are spaced apart from each other and are attached to and extend between the side support members 20. A pair of feet 24 (FIG. 3) may be attached to each of the side support members 20.

Figure 3:
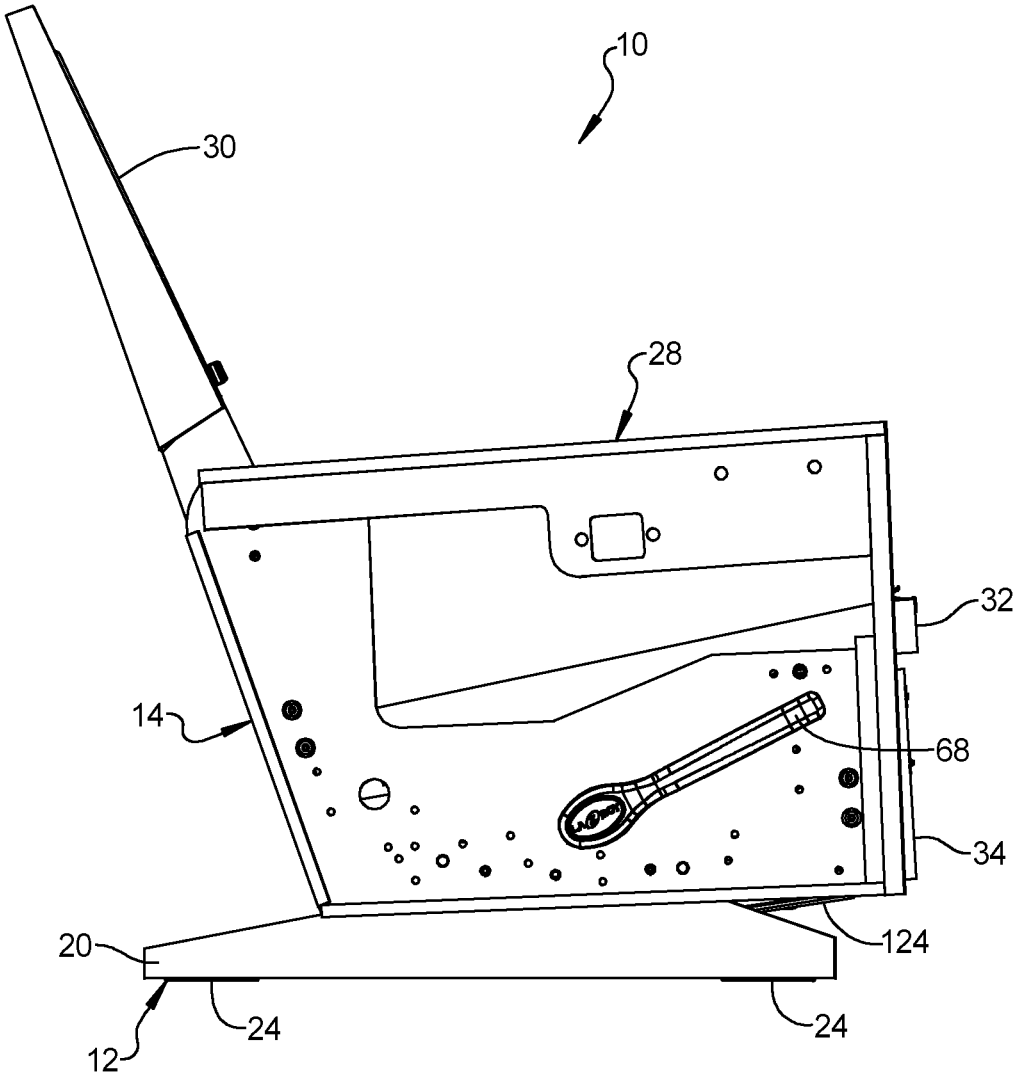
FIG. 3 is a side view of the furniture member in a nominal tilt position.
Figure 4:
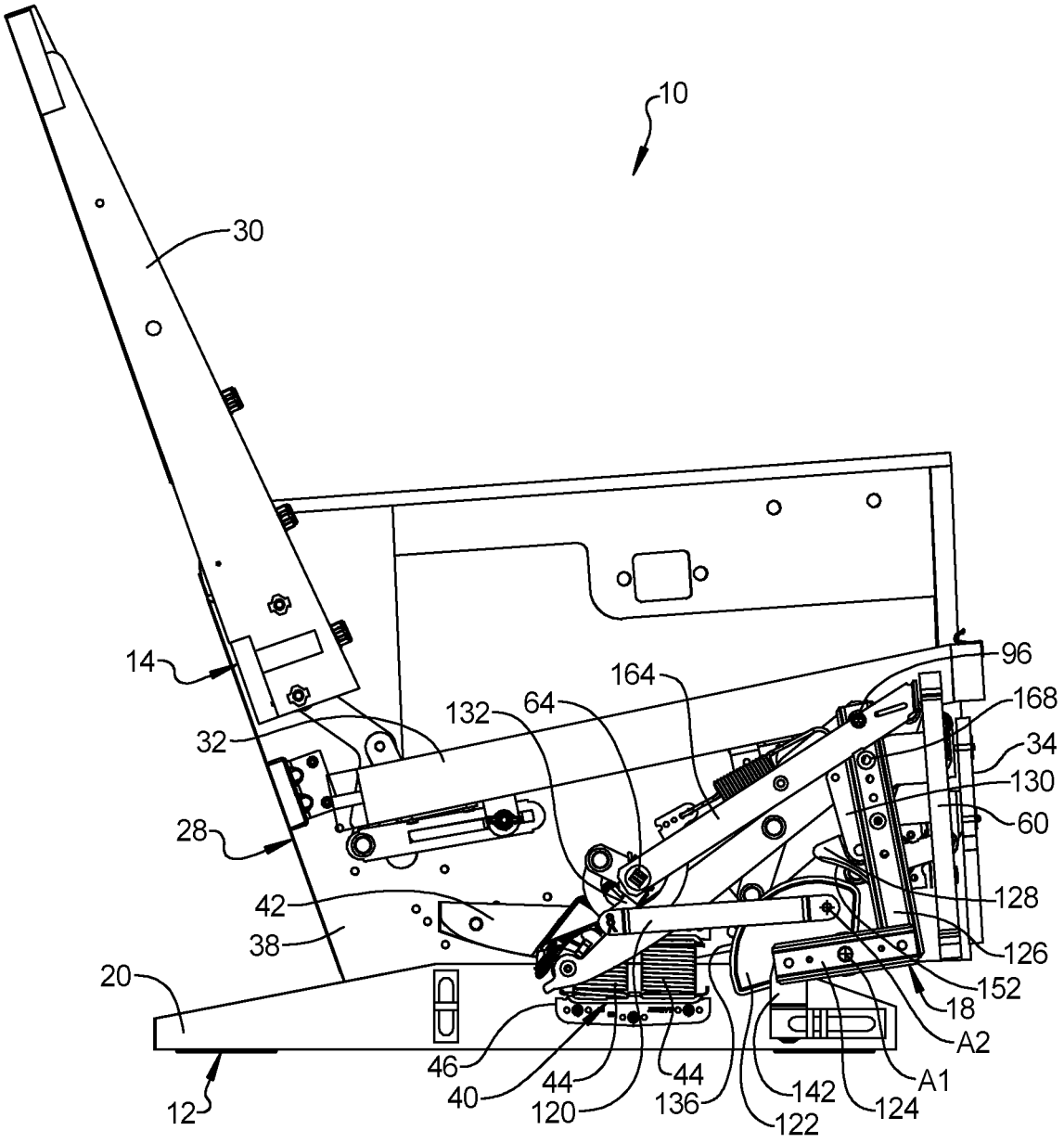
FIG. 4 is a side view of the furniture member in the nominal tilt position and with portions of a base frame and seat frame removed to more clearly show a tilt mechanism in an unlocked position.
Figure 5:
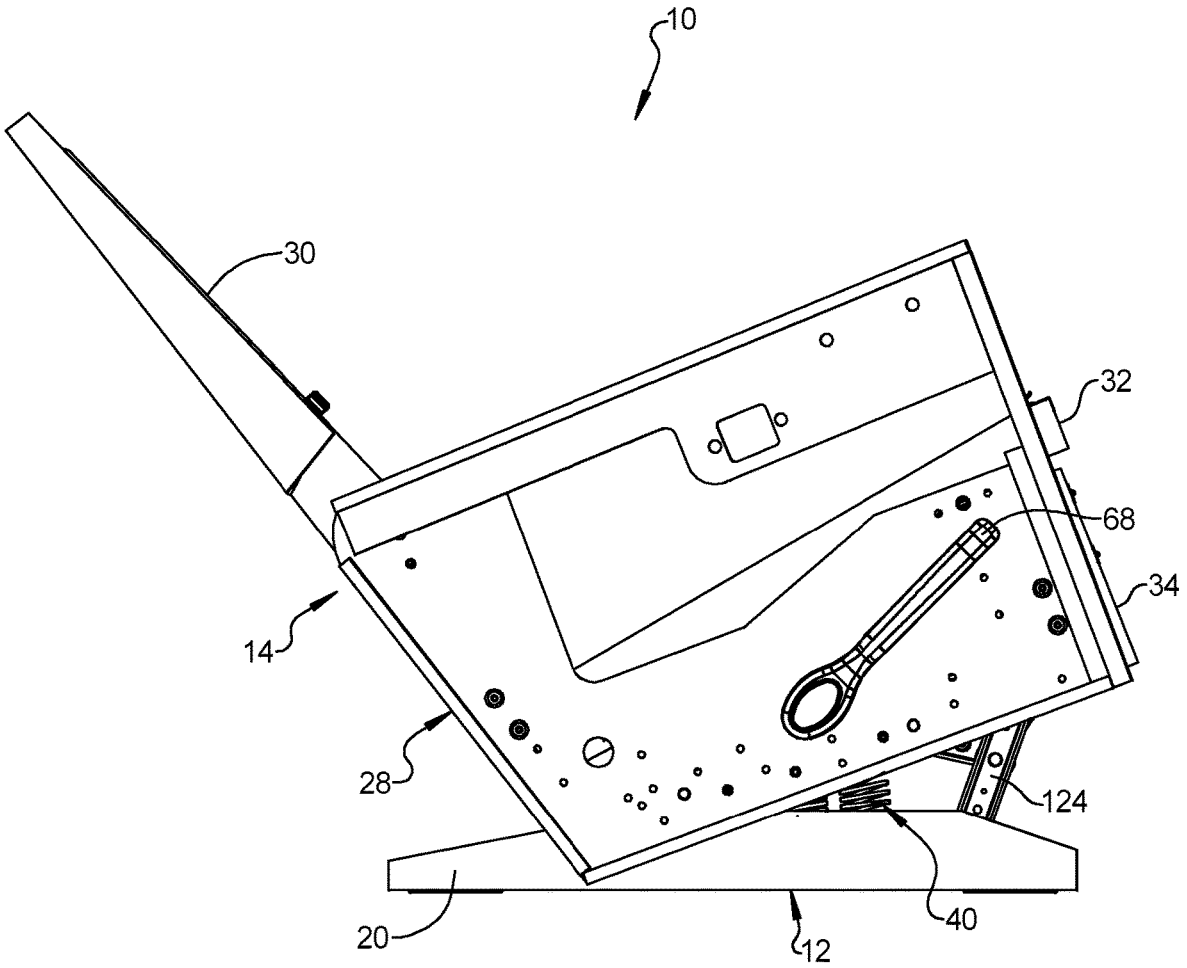
FIG. 5 is a side view of the furniture member in a rocked-back tilt position.
Figure 6:
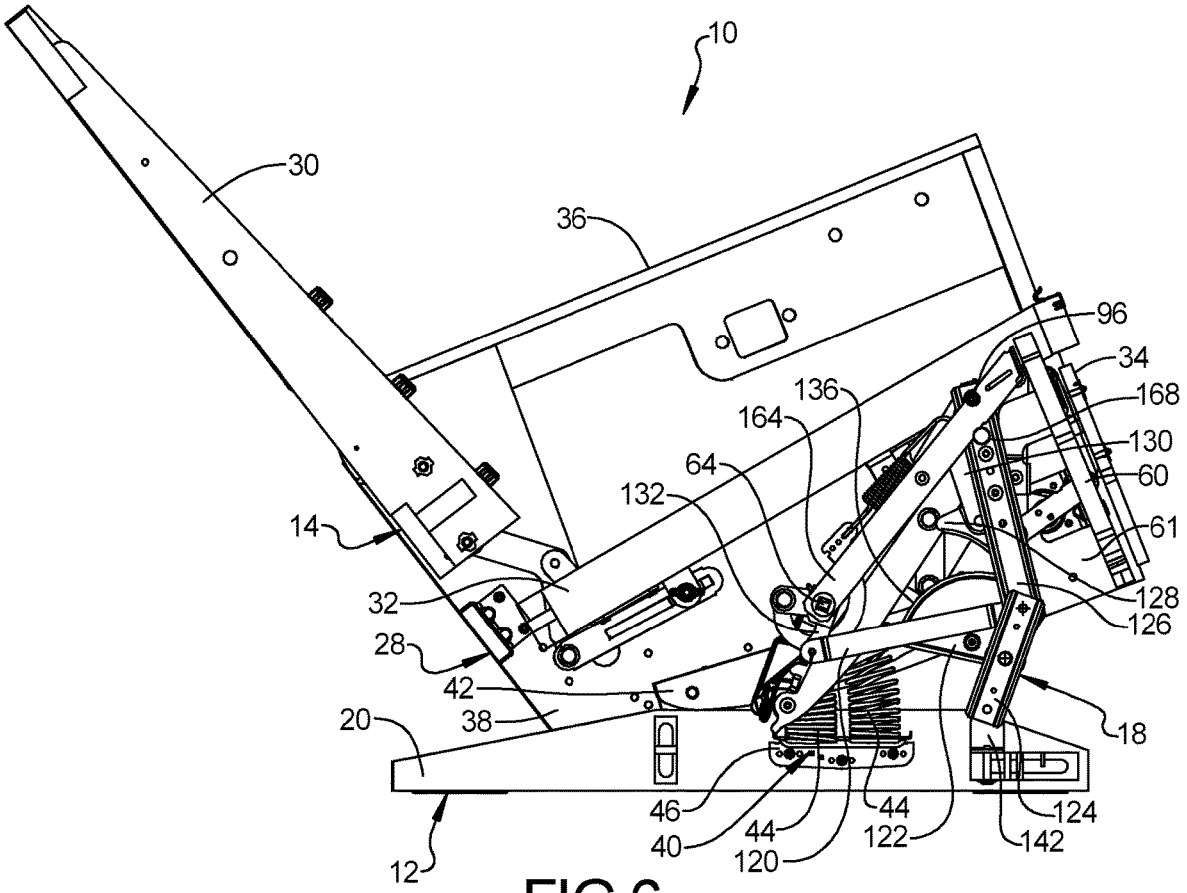
FIG. 6 is a side view of the furniture member in the rocked-back tilt position and with portions of the base frame and seat frame removed to more clearly show the tilt mechanism in the unlocked position.
Figure 7:
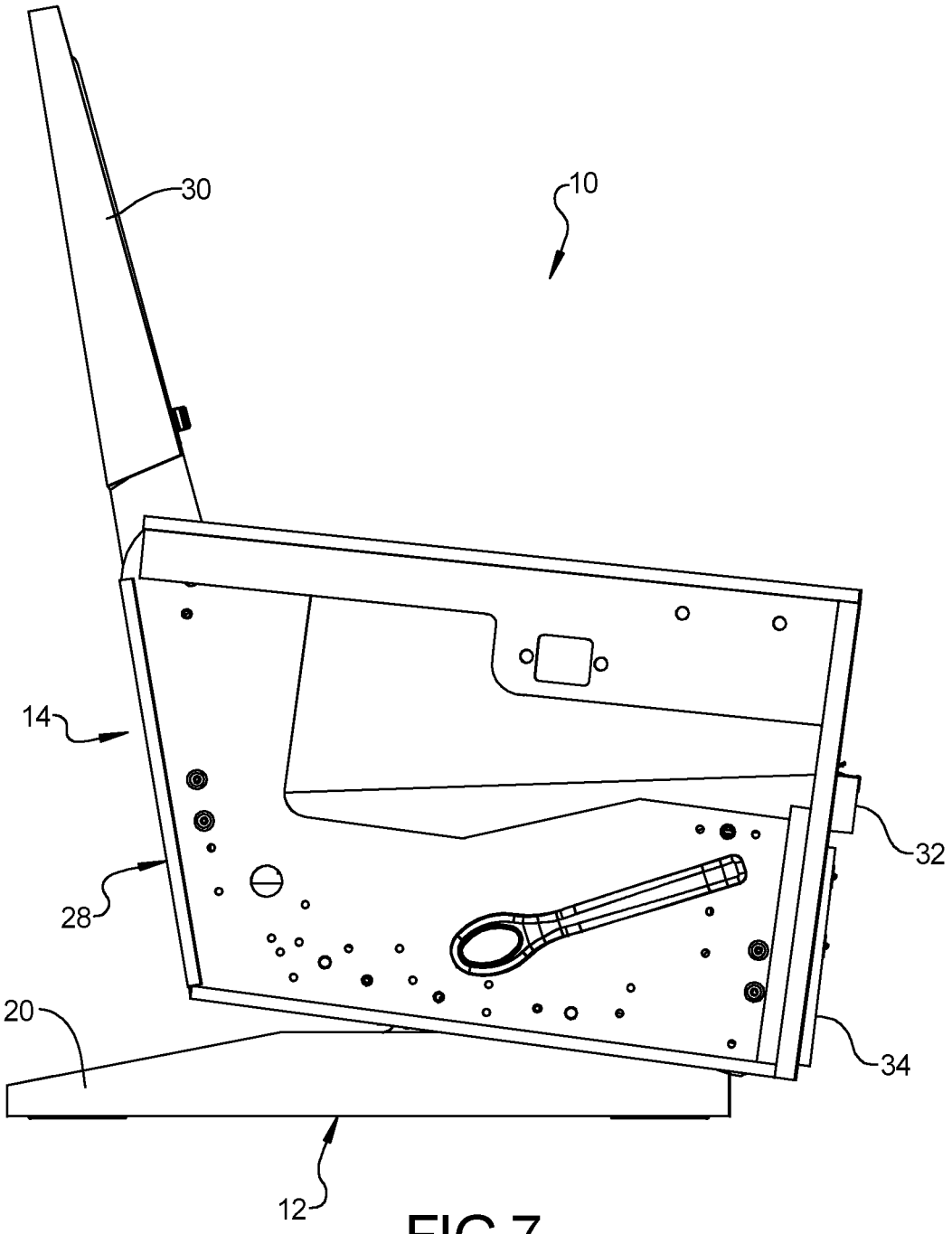
FIG. 7 is a side view of the furniture member in a rocked-forward tilt position.
Figure 8:
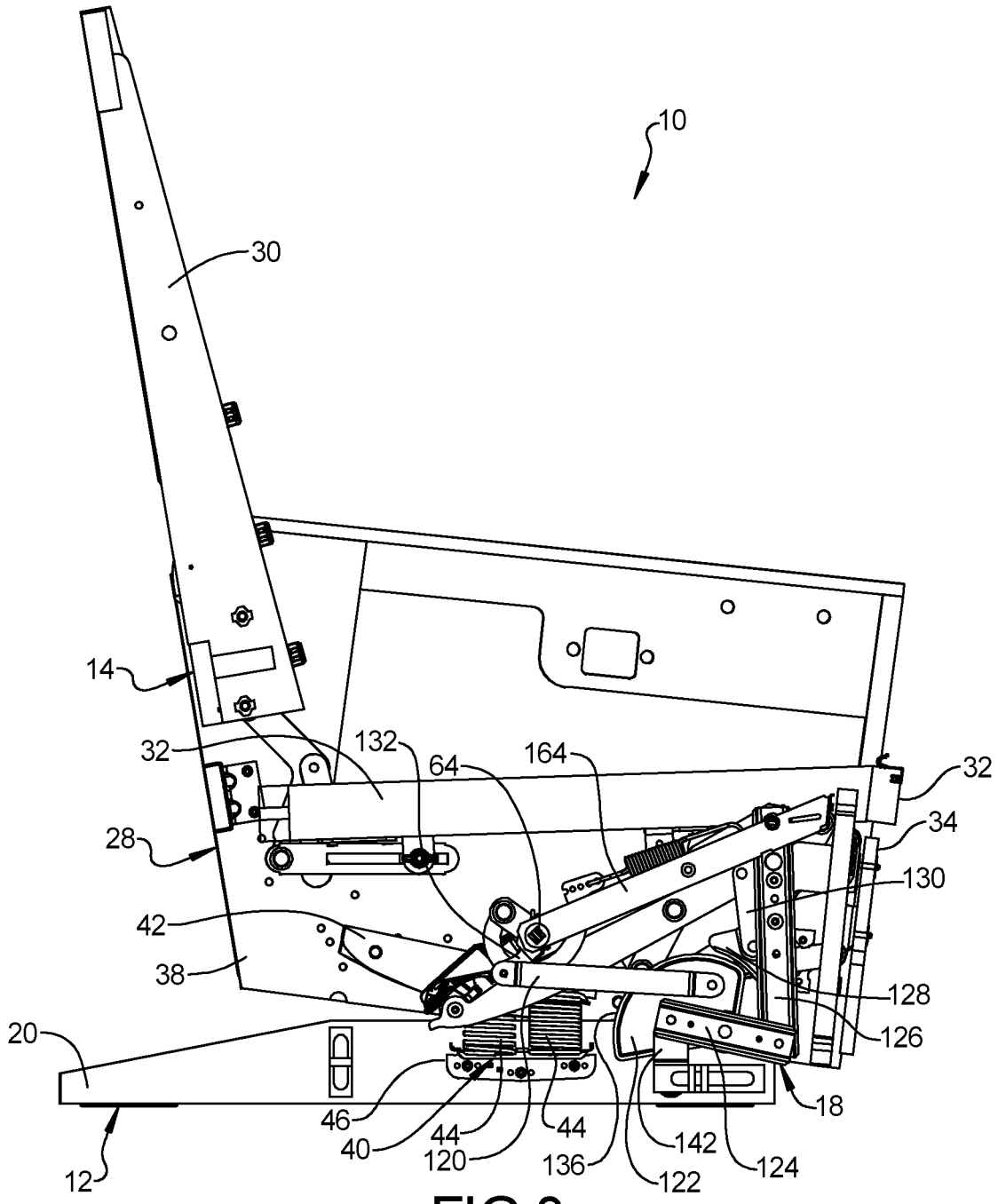
FIG. 8 is a side view of the furniture member in the rocked-forward tilt position and with portions of the base frame and seat frame removed to more clearly show the tilt mechanism in the unlocked position.

As shown in FIGS. 1-8, the seat assembly 14 may include a seat frame 28, a seatback 30, a seat bottom 32, and a legrest platform 34. The seat frame 28 may include a plurality of armrests 36 and a seat base 38 that supports the seatback 30, the seat bottom 32 and the legrest mechanism 16. As shown in FIGS. 4, 6 and 8, a pair of rocker assemblies 40 (only one of which is shown in the figures) may be attached to the seat base 38 and the base frame 12 to allow the seat assembly 14 to rock relative to the base frame 12 among the nominal, rocked-back and rocked-forward tilt positions.

Each rocker assembly 40 includes a rocker member 42 and a pair of springs 44. The rocker member 42 is fixedly attached to the seat base 38 and rollingly contacts a corresponding one of the side support members 20 of the base frame 12. Each pair of springs 44 are attached via brackets 46 to the corresponding rocker member 42 and the corresponding side support member 20. The springs 44 allow the rocker members 42 to rock along the side support members 20 between the rocked-back and rocked-forward tilt positions (FIGS. 5-8) while biasing the rocker members 42 (and hence, the seat assembly 14) toward the nominal position (FIGS. 3 and 4). The rocker assemblies 40 could have the structure and function of those disclosed in Assignee's U.S. Pat. No. 9,314,101, the disclosure of which is hereby incorporated by reference.

Figure 15:
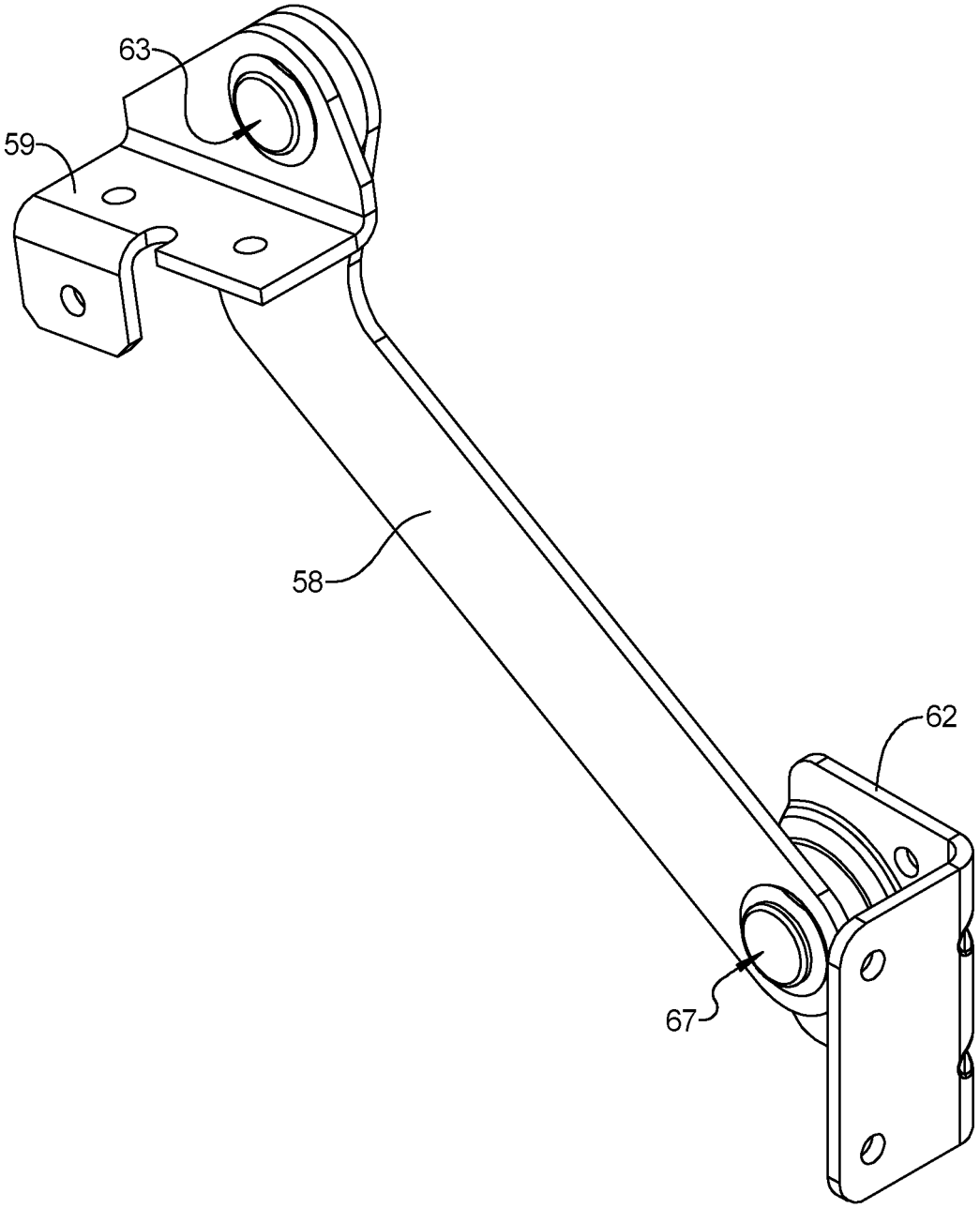
FIG. 15 is a perspective view of a front swing link and brackets.
Figure 16:
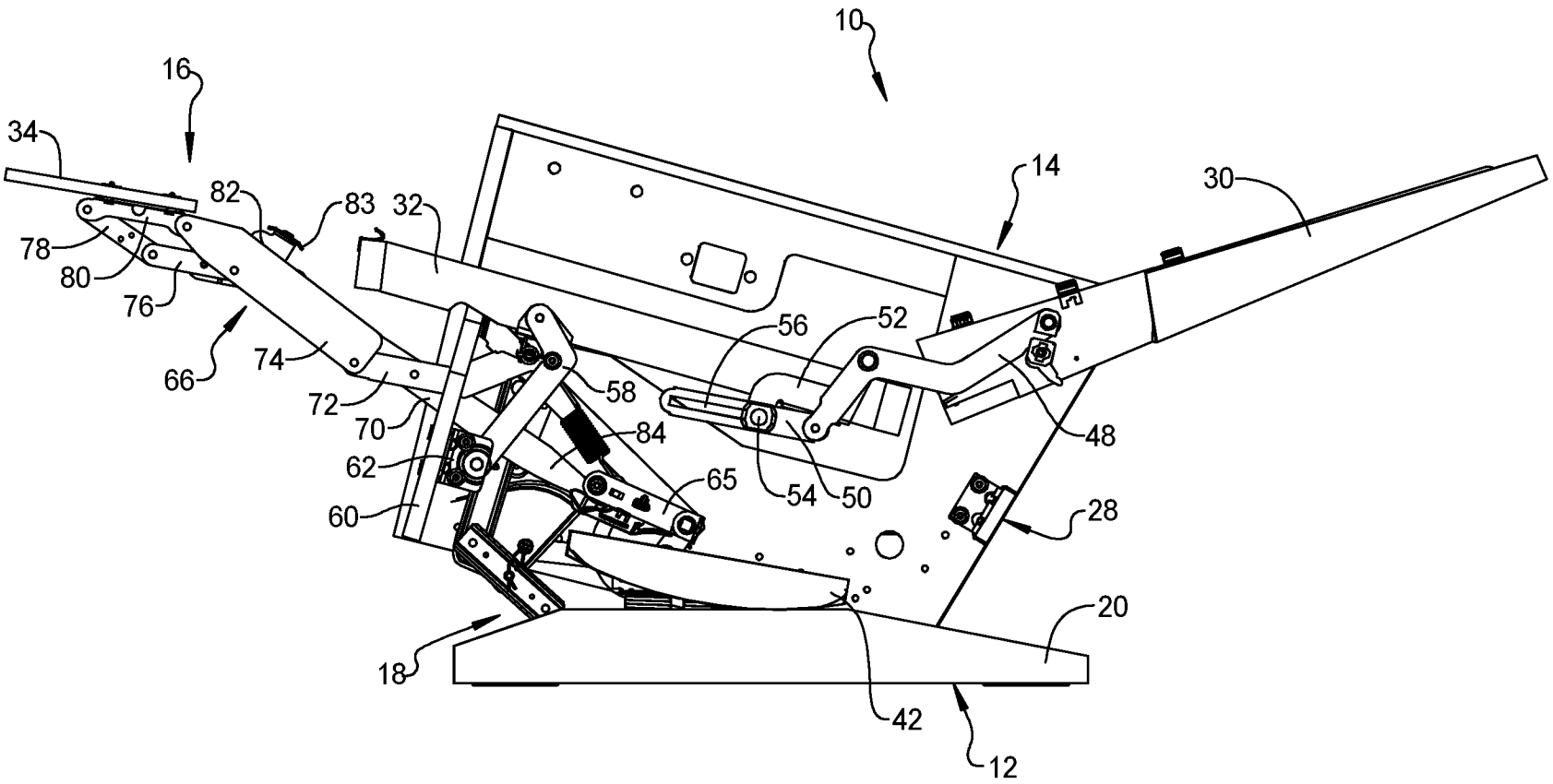
FIG. 16 is another side view of the furniture member in the rocked-back tilt position with the seatback in the reclined position and the legrest mechanism in the extended position and with portions of the base frame and seat frame removed to more clearly show the tilt mechanism in the locked position.
Figure 17:
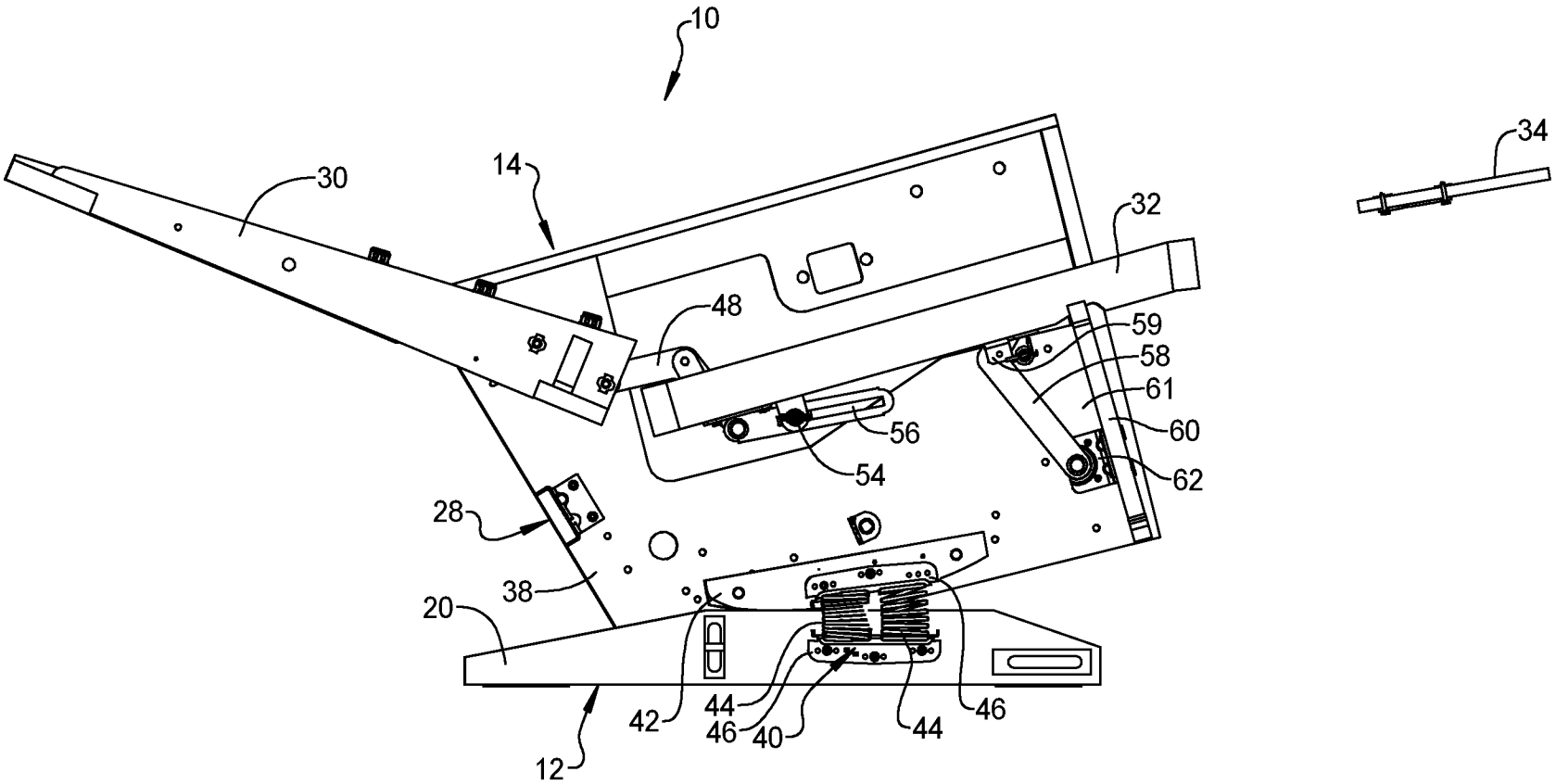
FIG. 17 is a side view of the furniture member with the seatback in the reclined position with portions of the base frame, seat frame, legrest mechanism and tilt mechanism removed to more clearly show a position of the front swing link.
Figure 18:
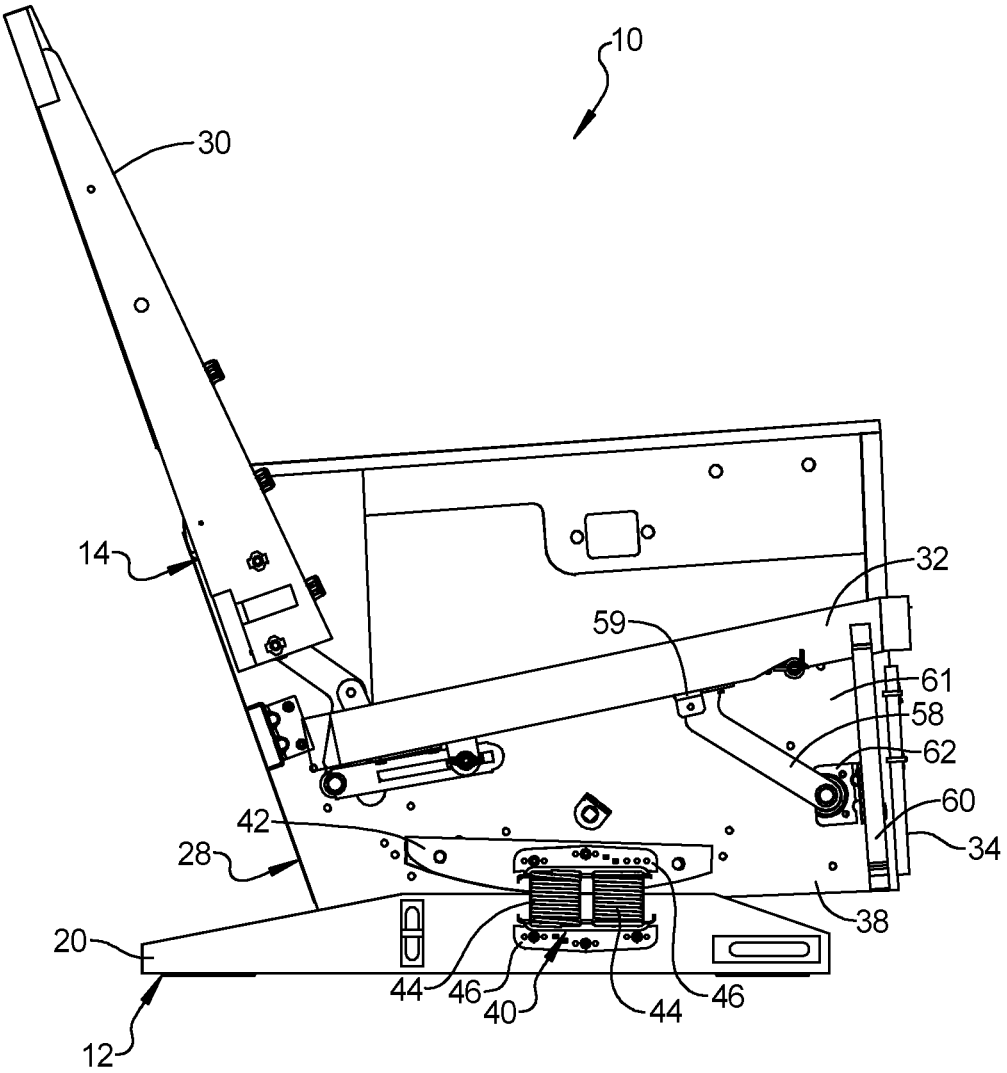
FIG. 18 is a side view of the furniture member with the seatback in the upright position with portions of the base frame, seat frame, legrest mechanism and tilt mechanism removed to more clearly show a position of the front swing link.
Figure 19:
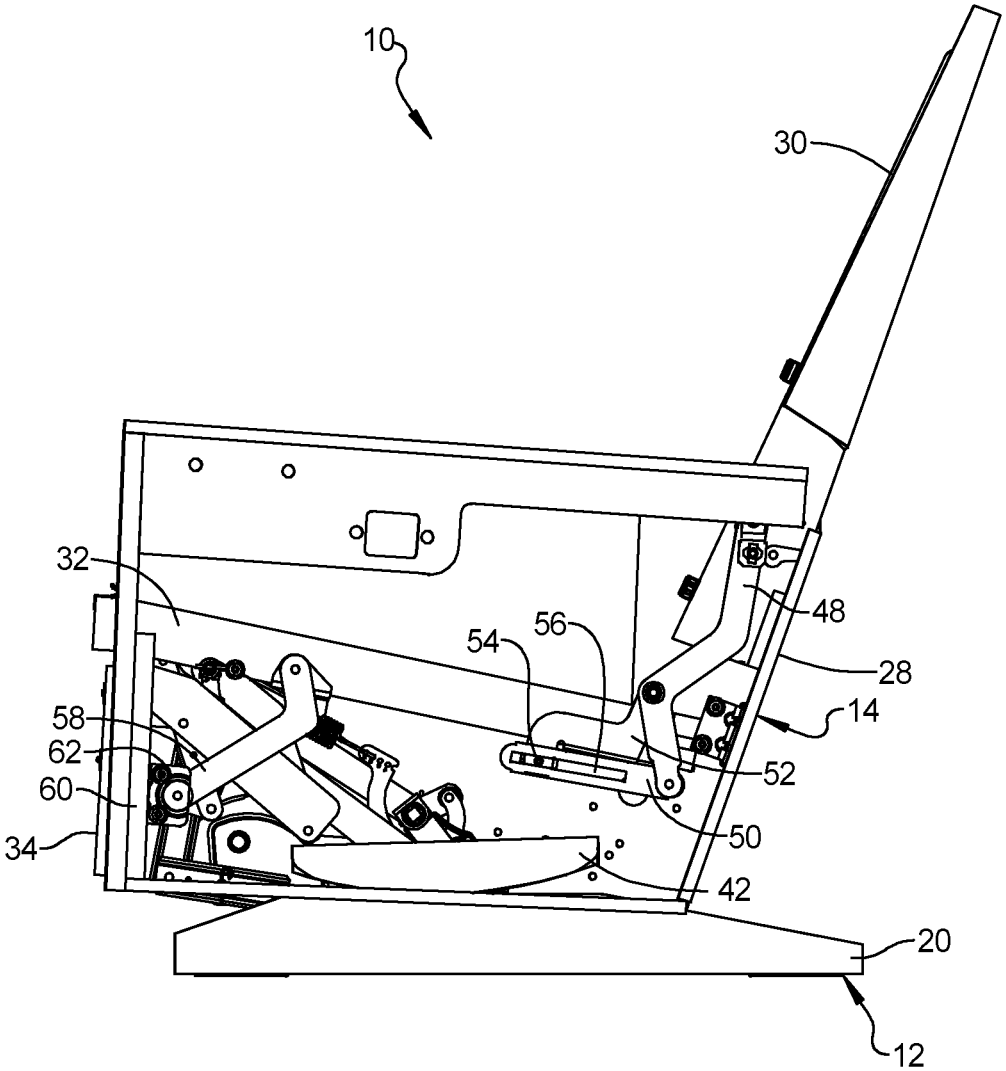
FIG. 19 is another side view of the furniture member with the seatback in the upright position with portions of the base frame and seat frame removed to more clearly show positions of the front swing link and links connecting the seatback and seat bottom.

As shown in FIGS. 16 and 19, the seatback 30 is rotatably coupled to the seat base 38 to allow the seatback 30 to rotate relative to the seat frame 28 and the seat bottom 32 between the fully upright position (e.g., FIGS. 18 and 19) and the fully reclined position (e.g., FIGS. 16 and 17). The seatback 30 is pivotably coupled to the seat frame 28 by a pair of rear swing links 48. Each rear swing link 48 is pivotably coupled to a friction link 50 and a rear arm 52. The rear arms 52 include fasteners 54 that slidably engage slots 56 in the friction links 50. The seat bottom 32 is supported by the rear arms 52 and a pair of front swing links 58 (FIGS. 15, 16 and 19). As shown in FIG. 18, each front swing link 58 is rotatably coupled at one end to the seat bottom 32 via a first bracket 59 and coupled at the other end to a front rail plate 60 and a side rail plate 61 of the seat base 38 via a second bracket 62 (e.g., an L-shaped bracket). The front swing links 58 may be rotatably coupled to the brackets 59, 62 via preloaded joint assemblies 63, 67 (FIG. 15). The joint assemblies 63, 67 can be similar or identical to the joint assemblies disclosed in Assignee's co-pending U.S. patent application Ser. No. 15/174,060, the disclosure of which is hereby incorporated by reference.

The rear arms 52 and the front swing links 58 cooperate to support the seat bottom 32. When the seatback 30 rotates relative to the seat frame 28 between the upright and reclined positions, the slots 56 of the friction links 50 slide along the fasteners 54, and the front swing links 58 rotate relative to the seat bottom 32 and the front rail plate 60, thereby moving the seat bottom 32 forward relative to the seat frame 28 (compare FIGS. 16 and 19). Moving the seat bottom 32 forward and rearward using the front swing links 58 allows for an amount of material at or near the top corners of the front rail plate 60 to be increased as compared to seat bottoms that are moved forward and rearward using brackets (placed at the front of the seat bottom 32) having slots that slide along a support rod.

As shown in FIGS. 2 and 11-14, the legrest mechanism 16 may include the drive rod 64 (FIG. 2) and a pair of pantograph linkages 66 (only one of which is shown in the figures). A handle 68 (FIGS. 2 and 11) is connected to an end of the drive rod 64. Rotation of the handle 68 relative to the seat frame 28 causes corresponding rotation of the drive rod 64 relative to the seat frame 28. The drive rod 64 is rotatably coupled to drive links 65 (FIG. 2; only one of which is shown in the figures) which is rotatably coupled to the pantograph linkages 66 such that rotation of the drive rod 64 causes the pantograph linkages 66 to move between the retracted position (FIG. 2) and the extended position (FIGS. 11-14). The legrest platform 34 is attached to and supported by the pantograph linkages 66 such that a user may rest his or her legs and/or feet on the legrest platform 34 while sitting in the furniture member 10 with the legrest mechanism 16 in the extended position.

Figure 21:
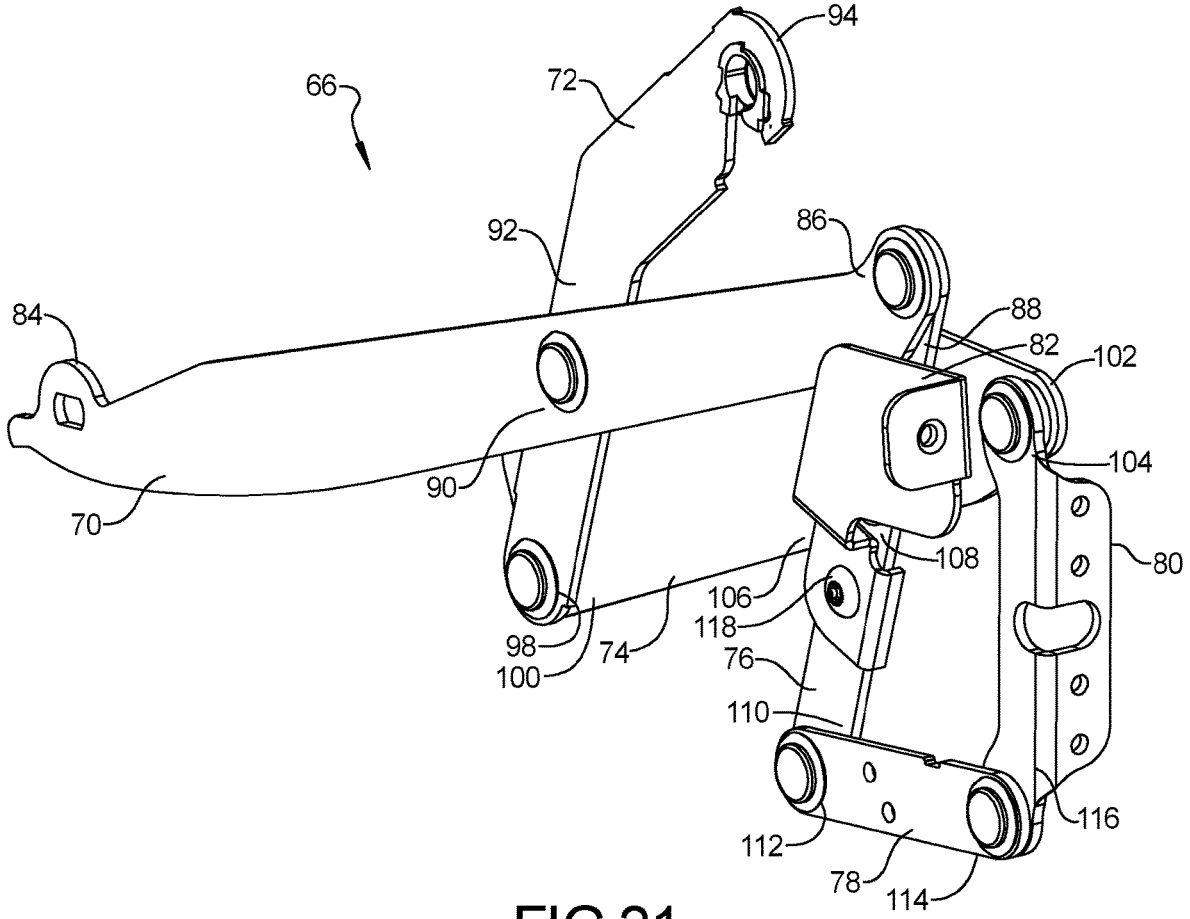
FIG. 21 is a perspective view of a pantograph linkage of the legrest mechanism with the mid-ottoman bracket attached according to the principles of the present disclosure.
Figure 23:
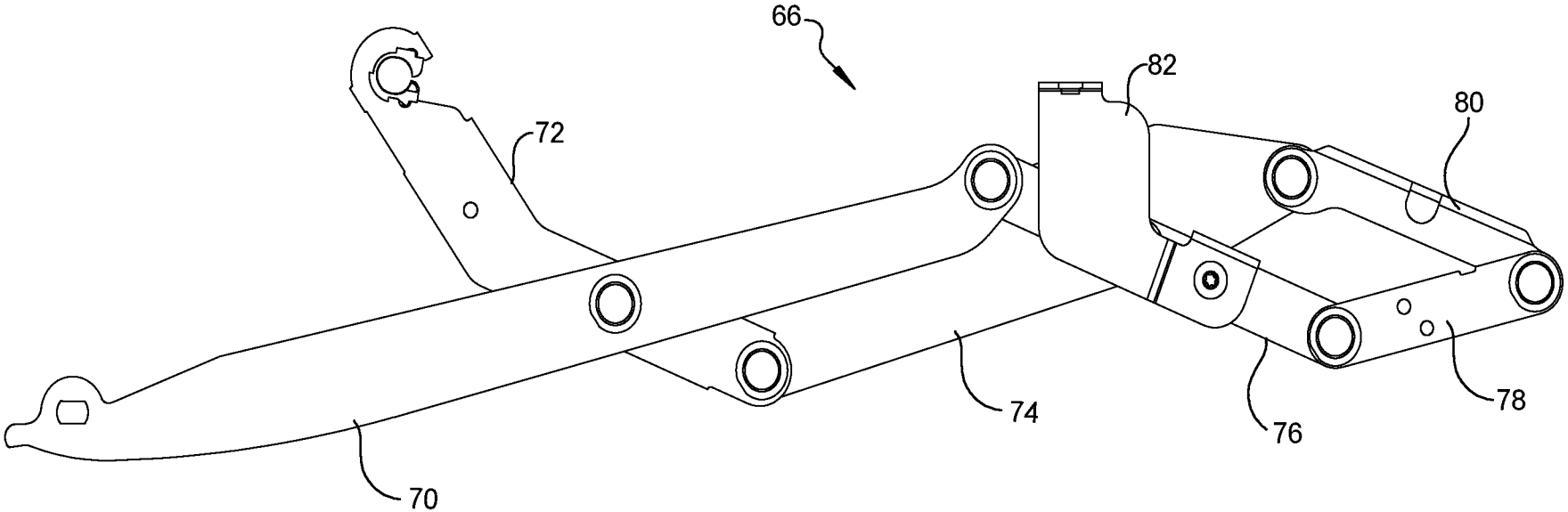
FIG. 23 is a side view of the pantograph linkage of FIG. 21 in a fully extended position.
Figure 24:
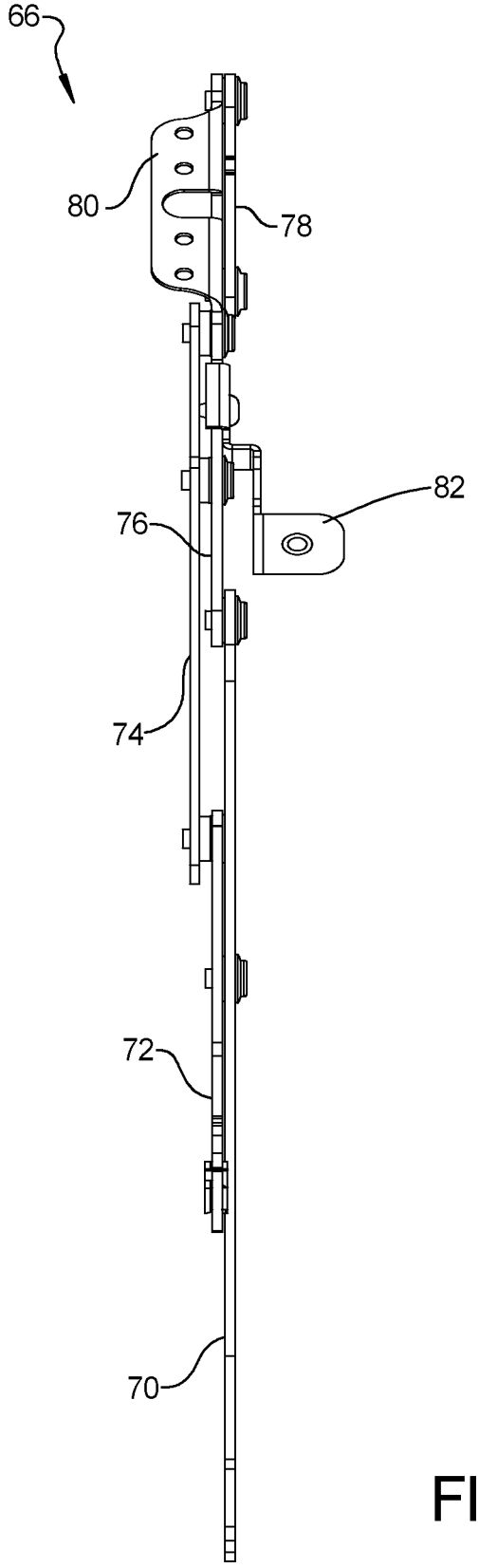
FIG. 24 is a top view of the pantograph linkage of FIG. 21 in the fully extended position.

As shown in FIGS. 21, 23, and 24, each of the pantograph linkages 66 may include a first support link 70, a swing link 72, a second support link 74, a cross link 76, a third support link 78, a bracket link 80, and a mid-ottoman bracket 82. In some configurations, preloaded joint assemblies similar or identical to the joint assemblies disclosed in Assignee's commonly owned U.S. Pat. No. 9,986,832 can be utilized to rotatably couple any of two or more of the links 70, 72, 74, 76, 78, 80 to each other.

Figure 20:
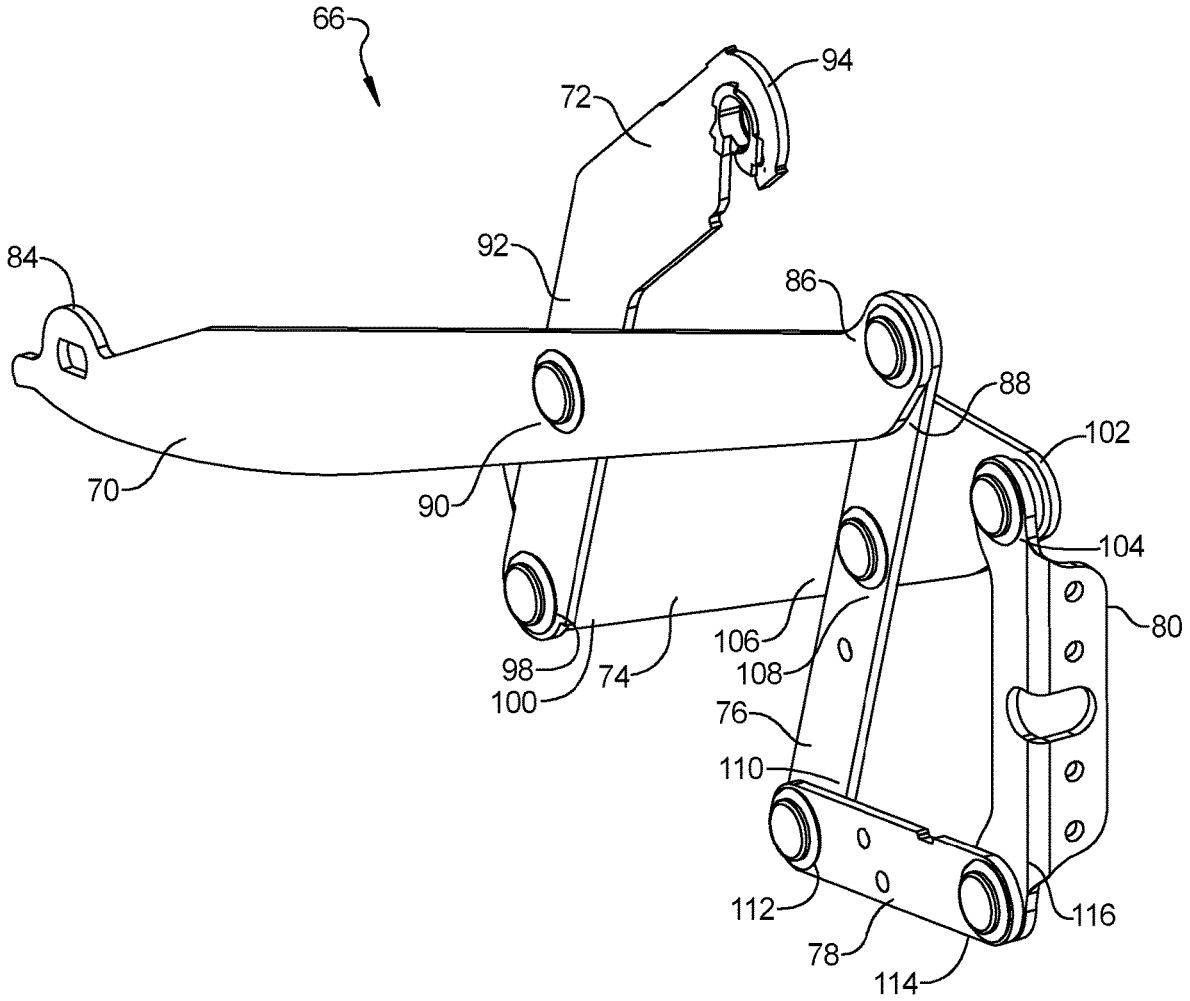
FIG. 20 is a perspective view of a pantograph linkage of the legrest mechanism with a mid-ottoman bracket removed according to the principles of the present disclosure.

As shown in FIGS. 14 and 16, a first end 84 of the first support link 70 may be rotatably coupled to an end of the drive link 65. As shown in FIGS. 20 and 21, a second end 86 of the first support link 70 is rotatably coupled to a first end 88 of the cross link 76. An intermediate portion 90 of the first support link 70 (disposed between the first and second ends 84, 86) is rotatably coupled to an intermediate portion 92 of the swing link 72.

In some configurations, the first support link 70 can be a substantially flat member without any offsets, as shown in FIGS. 20 and 21. Forming the first support link 70 without offsets improves the load capacity of the first support link 70. In some configurations, the swing link 72, the second support link 74, the cross link 76, and the third support link 78 may also be substantially flat members without any offsets. As shown in FIG. 21, the first support link 70 may be formed with varying width to provide improved column strength. For example, the increasing width of the first support link 70 as the first support link 70 extends from the intermediate portion 90 to the first end 84 improves resistance to buckling from compressive loads that originate from the pivots at the second end 86 and the intermediate portion 90). The width of the first support link 70 can be narrower between the intermediate portion 90 and the second end 86, where the distance between the pivots at the second end 86 and the intermediate portion 90 is shorter than the distance between the pivots at the first end 84 and the intermediate portion 90.

Forming the links 70, 72, 74, 76, 78 as flat members without any offsets also allows the links 70, 72, 74, 76, 78 to be non-handed (i.e., identical links can be used in the right-hand-side pantograph linkage 66 and in the left-hand-side pantograph linkage 66 of the seat assembly 14).

The links 70, 72, 74 are configured to travel side-by-side between the retracted and extended positions to prevent spaces between the links 70, 72, 74 from opening and closing during movement of the pantographs 66 so that foreign objects cannot be inadvertently inserted into such spaces and pinched during movement between the retracted and extended positions. As shown in FIG. 24, the links 70, 78 are in line with each other (i.e., disposed in the same plane), and the links 72, 76 and part of link 80 (i.e., the portion of link 80 that extends toward and away from the legrest platform 34) are in line with each other. The second support link 74 may be spaced outward from the links 72, 76. As shown in FIGS. 13, 20, and 23, the second support link 74 may be formed wide enough to block potential pinch-points between the links 70, 72 and between links 70, 76. In this manner, the second support link 74 may be multi-functional—i.e., a structural link, a guard to block pinch-points, and an aesthetic member that partially cover the rotation of links 72, 76 when the legrest mechanism is in the extended position.

A first end 94 of the swing link 72 may be rotatably coupled to a support rod 96 (FIG. 2) that is mounted to the seat frame 28. As shown in FIG. 21, a second end 98 of the swing link 72 may be rotatably coupled to a first end 100 of the second support link 74. The intermediate portion 92 of the swing link 72 is disposed between the first and second ends 94, 98.

As shown in FIGS. 20 and 21, a second end 102 of the second support link 74 is rotatably coupled to a first end 104 of the bracket link 80. As shown in FIG. 20, an intermediate portion 106 of the second support link 74 (disposed between the first and second ends 100, 102) is rotatably coupled to an intermediate portion 108 of the cross link 76. A second end 110 of the cross link 76 is rotatably coupled to a first end 112 of the third support link 78. A second end 114 of the third support link 78 is rotatably coupled to a second end 116 of the bracket link 80. The legrest platform 34 may be fixedly attached to the bracket link 80, as shown in FIG. 14.

The mid-ottoman bracket 82 may support a mid-ottoman platform 83 (FIGS. 14 and 16) such that the mid-ottoman platform 83 is positioned between the seat bottom 32 and the legrest platform 34 when the legrest mechanism 16 is in the extended position (FIG. 16). As shown in FIG. 21, the mid-ottoman bracket 82 may be fixedly (i.e., non-rotatably) attached to the cross link 76 by a fastener 118 (e.g., a screw, bolt, rivet, etc.). Attaching the mid-ottoman bracket 82 to the cross link 76 in this manner allows for the same pantograph linkages 66 to be used in non-chaise versions of the furniture member 10 (i.e., configurations having the mid-ottoman bracket 82 and mid-ottoman platform 83) and in chaise versions of the furniture member 10 (i.e., configurations that do not have the mid-ottoman bracket 82 and mid-ottoman platform 83). That is, the manufacturer of the furniture member 10 can optionally attach the mid-ottoman bracket 82 and mid-ottoman platform 83 to the cross link 76 (FIG. 21) for non-chaise versions of the furniture member 10 or omit the mid-ottoman bracket 82 and mid-ottoman platform 83 (FIG. 20) for chaise versions of the furniture member 10 without making any changes to the structure of the pantograph linkage 66. This reduces the number of sub-assemblies that the manufacturer needs to have in inventory to offer chaise and non-chaise configurations of the furniture member 10.

In some configurations, one or more of the links 70, 72, 74, 76, 78, 80 of the pantographs 66 could be made longer to increase the distance between the seat bottom 32 and the legrest platform 34. To accommodate the longer links, openings in the front rail plate 60 may need to be made larger and/or the base frame 12 may need to be heightened so that the seat assembly 14 is higher off of the ground.

Figure 9:
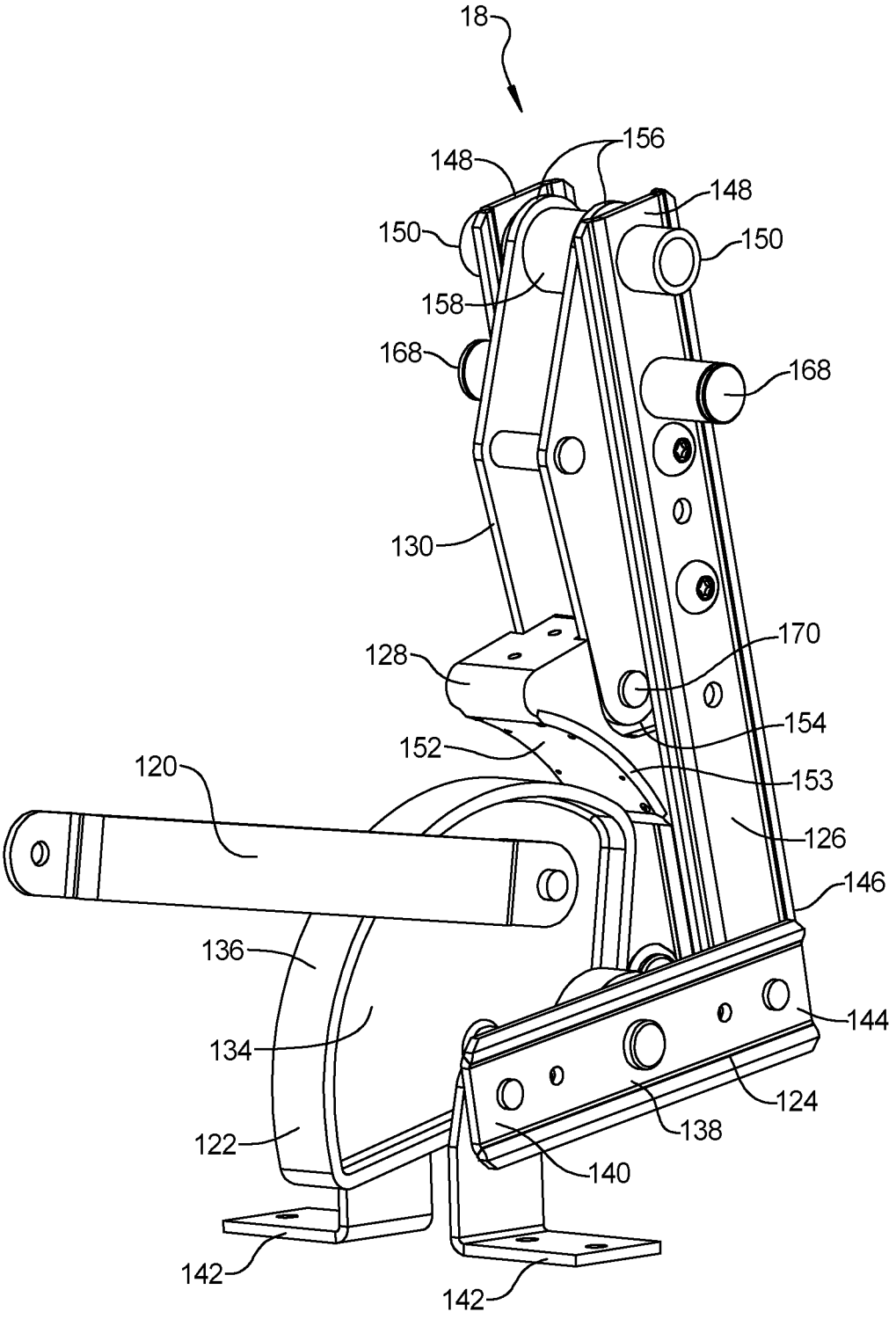
FIG. 9 is a perspective view of the tilt mechanism in the unlocked position.
Figure 10:
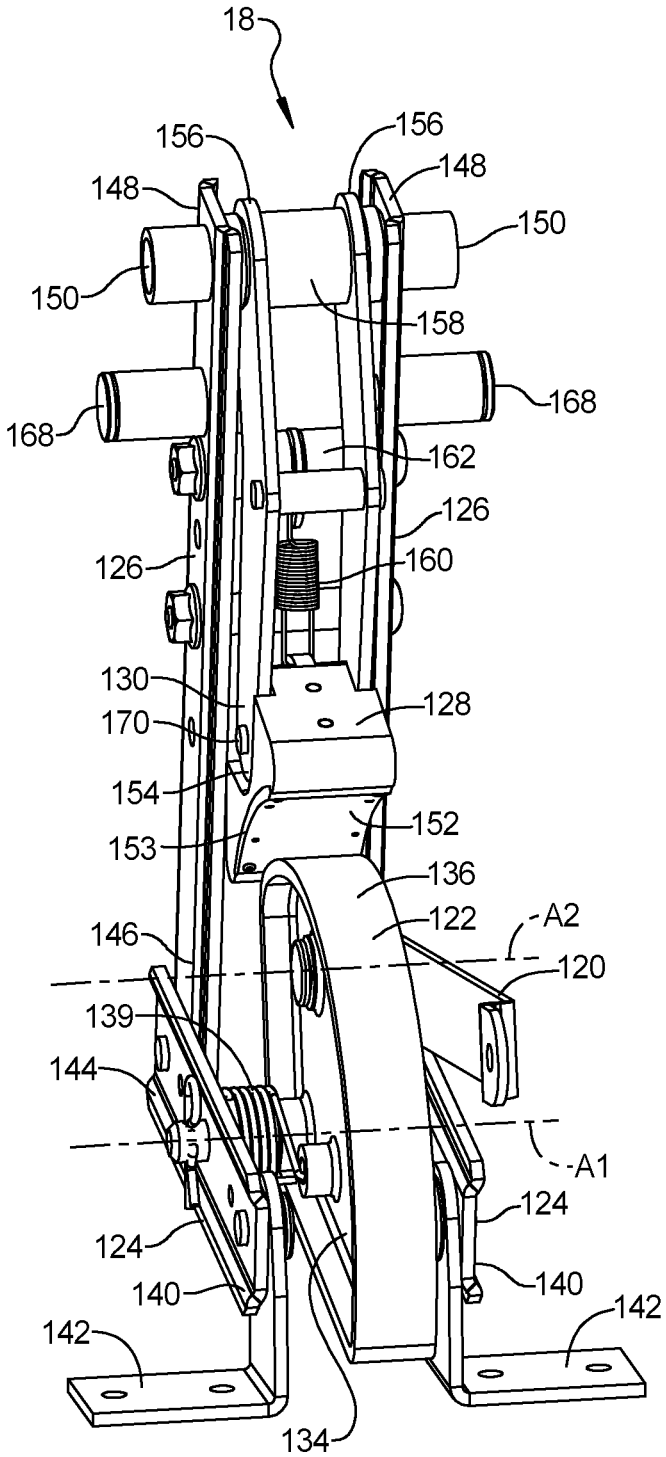
FIG. 10 is another perspective view of the tilt mechanism in the unlocked position.
Figure 11:
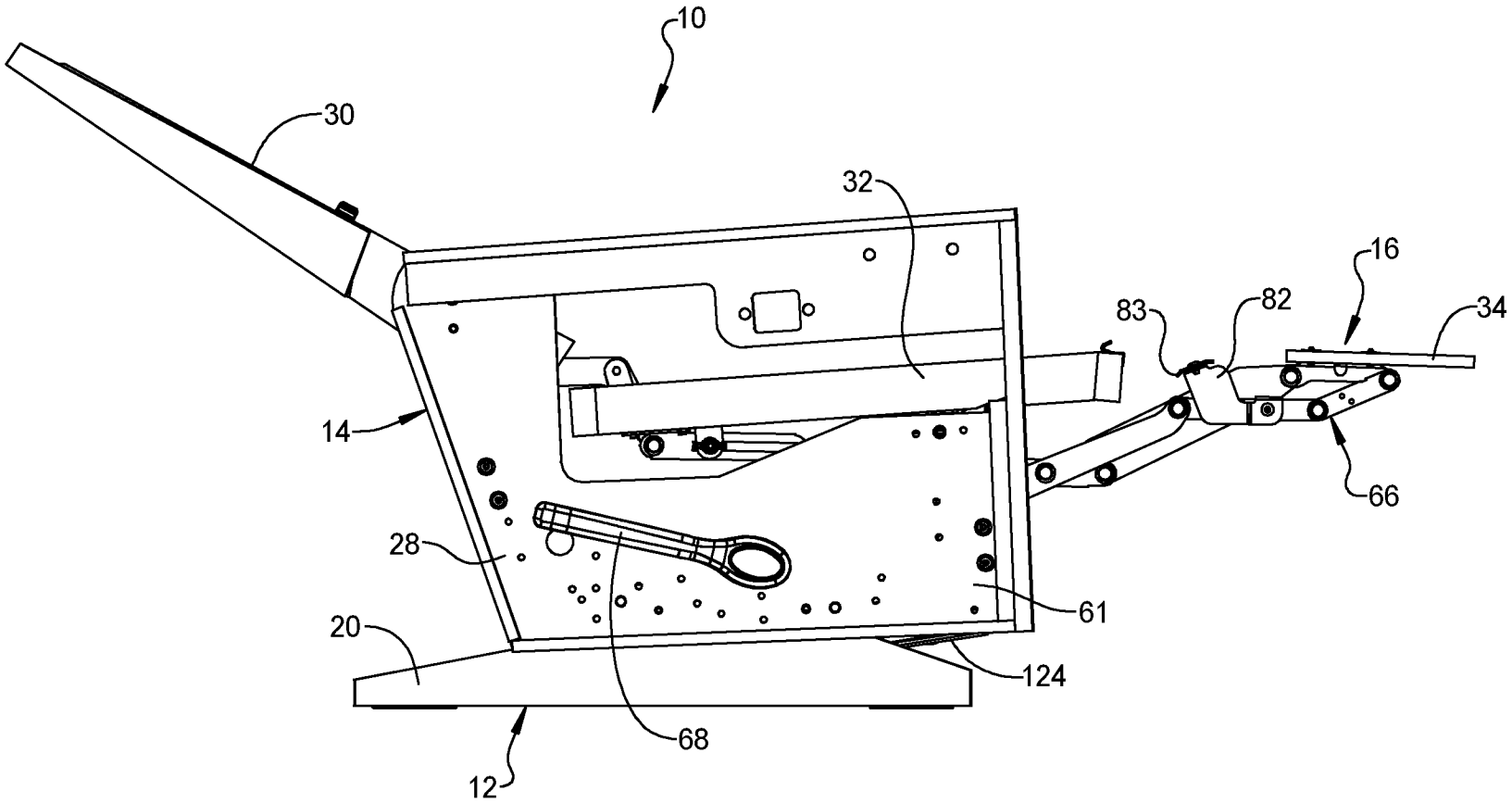
FIG. 11 is a side view of the furniture member in the nominal tilt position with a seatback in a reclined position and a legrest mechanism in an extended position.

As shown in FIGS. 9 and 10, the tilt mechanism 18 may include an actuation link 120, a cam 122, a pair of cam support links 124, a pair of connecting links 126, a cam follower 128, and a pair of cam follower support links 130. The actuation link 120 may be rotatably coupled at one end to a crank link 132 (FIGS. 2 and 4) and rotatably coupled at the other end to the cam 122. As shown in FIG. 2, the crank link 132 is coupled to the drive rod 64 such that rotation of the drive rod 64 (via handle 68) causes corresponding motion of the crank link 132 and the actuation link 120.

As shown in FIGS. 9 and 10, the cam 122 includes a cam body 134 and a convex curved cam surface 136 that defines a portion of the outer periphery of the cam body 134. The cam body 134 may be rotatably coupled to an intermediate portion 138 of each of the cam support links 124. One or more torsion springs 139 (FIG. 10) are attached to the cam body 134 and the cam support links 124 and rotationally bias the cam 122 relative to the cam support links 124 in a clockwise direction (relative to the frame of reference of FIG. 4). First ends 140 of the cam support links 124 are rotatably coupled to brackets 142 that are fixedly mounted to the base frame 12 (e.g., one of the cross members 22). Second ends 144 of the cam support links 124 are rotatably coupled to first ends 146 of the connecting links 126. As shown in FIG. 2, the second ends 148 of the connecting links 126 are rotatably coupled to the support rod 96 (which is attached to the seat frame 28) via one or more bushings 150. Because the cam support links 124 are mounted for rotation relative to the base frame 12, and the connecting links 126 are rotatably mounted to the cam support links 124 for rotation relative to the seat frame 28, the rocking motion of the seat assembly 14 relative to the base frame 12 between the rocked-back and rocked-forward tilt positions causes corresponding rotation of the cam support links 124 and the connecting links 126 (see FIGS. 4, 6 and 8).

As shown in FIGS. 9 and 10, the cam follower 128 includes a cam engagement surface 152 and is rotatably coupled to a first end 154 of each cam follower support link 130. The cam engagement surface 152 is a concave surface having a radius that substantially matches a radius of the convex cam surface 136 of the cam 122. In some configurations, a friction pad 153 is attached to a main body of the cam follower 128. The friction pad 153 may define the cam engagement surface 152 and may be formed from a material having a higher coefficient of friction than a material from which the main body of the cam follower 128 is formed. For example, the main body of the cam follower 128 may be formed from a relatively hard polymer or metal, and the friction pad 153 can be formed from urethane (e.g., with a Shore hardness of about 60 A) or any other polymer or elastomer that allows for improved grip with the cam surface 136. In some configurations, the friction pad 153 can be attached to the cam follower 128 with brads or other fasteners. In some configurations, the cam surface 136 may include a surface texture (i.e., scratches and/or scuffs formed by rubbing steel wool or other abrasive material on the cam surface 136) that increases the coefficient of friction of the cam surface 136. In some configurations, the cam follower 128 can be formed from a single, homogenous material selected such that the minimum coefficient of friction between the cam follower 128 and the cam 122 is approximately 0.5, for example.

A second end 156 of each cam follower support link 130 is rotatably coupled to the support rod 96 and the second ends 148 of the connecting links 126 via a bushing 158. As shown in FIG. 10, a spring 160 is attached to the cam follower 128 and to a peg 162 that is attached to and spans between the two connecting links 126. The spring 160 causes rotation of the cam follower 128 relative to the cam follower support links 130 as the cam follower support links 130 rotate relative to the connecting links 126. The peg 162 also acts as a stop member to limit to a range of relative rotation between the connecting links 126 and the cam follower support links 130. The spring 160 also rotationally biases the cam follower support links 130 toward the peg 162.

As shown in FIG. 2, brace members 164 are mounted to the drive rod 64 and the front rail plate 60. The drive rod 64 is allowed to rotate relative to the brace members 164. A cross member 166 extends between the brace members 164 and acts as a stop member to limit the range of rotational motion of the cam follower support links 130. The brace members 164 also support the support rod 96 and are supported by pegs 168 attached to the connecting links 126. In this manner, the tilt mechanism 18 can assist in supporting the weight of the seat bottom 32 and an occupant sitting on the seat bottom 32. The pegs 168 may act as an overall stop (as shown in FIG. 6) to prevent the cam support links 124 and the connecting links 126 from moving over-center at pivots defined by bushings 150 and ends 140, 144 of the cam support links 124.

With continued reference to FIGS. 1-21, operation of the tilt mechanism 18 will be described in detail. As described above, the seat assembly 14 is able to freely rock between the rocked-back and rocked-forward tilt positions while the legrest mechanism 16 is in the retracted position, as shown in FIGS. 3-8. As shown in FIGS. 12-14, when the legrest mechanism 16 is moved into the extended position, the tilt mechanism 18 locks the seat assembly 14 into a selected tilt position (i.e., the tilt mechanism 18 prevents the seat assembly 14 from rocking relative to the base frame 12 when the legrest mechanism is in the extended position). As the legrest mechanism 16 moves into the retracted position, the tilt mechanism 18 unlocks the seat assembly 14 relative to the base frame 12 to allow the seat assembly 14 to rock among the nominal, rocked-back, and rocked-forward tilt positions.

As described above, rotation of the handle 68 (FIG. 2) causes rotation of the drive rod 64 relative to the seat frame 28, which simultaneously moves the pantograph linkages 66 of the legrest mechanism 16 between the retracted and extended positions and moves actuation link 120 of the tilt mechanism 18. Comparing FIGS. 4 and 12, for example, it can be seen that rotation of the drive rod 64 causes corresponding rotation of the crank link 132, which pushes the actuation link 120 of the tilt mechanism 18 forward relative to the base frame 12 toward the front end of the furniture member 10 (i.e., toward the front rail plate 60). Such forward motion of the actuation link 120 causes the cam 122 to rotate relative to the cam support link 124 (about a rotational axis A1 (FIG. 10) extending through the cam 122 and the cam support links 124) from the unlocked position shown in FIG. 4 (in which the cam surface 136 of the cam 122 is spaced apart from the cam engagement surface 152 of the cam follower 128) to the locked position shown in FIG. 12 (in which the cam surface 136 of the cam 122 is engaged with the cam engagement surface 152 of the cam follower 128). A frictional force between the cam follower 128 and the cam 122 holds or locks the seat assembly 14 relative to the base frame 12 at the tilt position (e.g., rocked-back, nominal or rocked-forward) at which the seat assembly 14 is positioned when the legrest mechanism 16 is moved into at least a partially extended position.

In some configurations, full rotation of the handle 68 and drive rod 64 (i.e., rotation of the handle 68 to fully extend the legrest mechanism 16) is not necessary to engage the cam follower 128 with the cam 122. Rather, partial rotation (i.e., to partially extend the legrest mechanism 16) is all that may be required to engage the cam follower 128 with the cam 122. For example, in configurations of the furniture member 10 having a three-position legrest mechanism (e.g., such as the type disclosed in Assignee's commonly owned U.S. Pat. No. 8,132,855, the disclosure of which is hereby incorporated by reference), the cam follower 128 may be in full engagement with the cam 122 at all three partially or fully extended positions. Engagement of the cam follower 128 with the cam 122 at any of the three partially or fully extended positions can be accomplished at any position within the full range of tilt movement and does not limit the ability of the cam 122 and cam follower 128 to stop rocking movement.

As shown in FIGS. 4, 6 and 8, when the tilt mechanism 18 is in the unlocked position, rocking of the seat assembly 14 among the tilt positions causes the cam 122 to rotate about a rotational axis A2 (FIGS. 4 and 10) extending through the actuation link 120 and the cam 122. The frictional force between the cam follower 128 and the cam 122 when the tilt mechanism 18 is in the locked position prevents the cam 122 from rotating relative to the cam follower 128 and thus prevents the cam 122 from rotating about the rotational axis A2. Preventing rotation of the cam 122 about the rotational axis A2 prevents movement of the cam support links 124 and the connecting links 126 relative to the base frame 12, thereby preventing the seat assembly 14 from rocking relative to the base frame 12. Because the cam follower 128 only engages a portion of the cam surface 136 of the cam 122, the cam follower 128 can engage the cam 122 to lock seat assembly 14 in any of the infinite number of tilt positions between (and including) the fully rocked-back and fully rocked-forward tilt positions.

When the legrest mechanism 16 is moved from an extended position toward the retracted position (as shown in FIG. 14), the cam follower support links 130 can rotate clockwise (relative to the frame of reference of FIG. 14). Such rotation of the cam follower support links 130 reduces the frictional force between the cam follower 128 and the cam 122, thereby reducing the amount of force that the user is required to apply to rotate the handle 68 to unlock the tilt mechanism 18 and retract the legrest mechanism 16. Once the cam follower 128 disengages the cam 122, the spring 160 (FIG. 10) rotates the cam follower support links 130 counterclockwise (relative to the frame of reference of FIG. 14) back toward the peg 162.

As shown in FIG. 13, when the tilt mechanism 18 is in the locked position, a pivot 170 that defines a rotational axis of the cam follower 128 relative to the cam follower support links 130 is located in an over-center position in which the pivot 170 is located between the front rail plate 60 and a vertical axis A3 extending through the support rod 96 and the rotational axis A1. When the pivot 170 is in this over-center position, the cam follower support links 130 assist in supporting the load from an occupant's weight and a load applied by the springs 44 of the rocker assemblies 40. As shown in FIG. 14, when the legrest mechanism 16 is moved from the extended position toward the retracted position, the clockwise rotation (relative to the frame of reference of FIG. 14) of the cam follower support links 130 described above moves the pivot 170 out of the over-center position (i.e., such that the axis A3 is located between the axis A3 and the front rail plate 60), which reduces the load on the cam follower support links 130, thereby reducing the amount of force that the user is required to apply to rotate the handle 68 to unlock the tilt mechanism 18 and retract the legrest mechanism 16, as described above.

Figure 22:
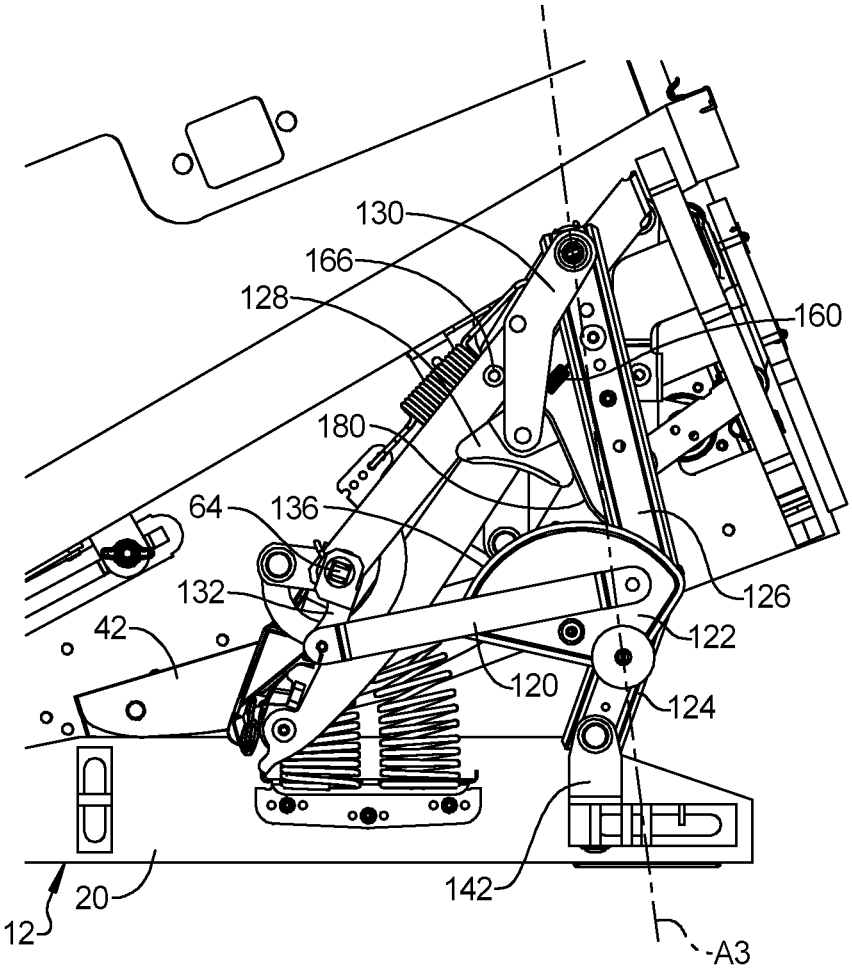
FIG. 22 is partial side view of the furniture member with another configuration of the tilt mechanism in an unlocked position.

As shown in FIG. 22, in some configurations, the cam follower 128 may include a cam follower runner 180 (e.g., a thin, flexible tab) extending therefrom that slidably engages the cam surface 136 of the cam 122 when the tilt mechanism 18 is in the unlocked position. Contact between the cam follower runner 180 and the cam surface 136 keeps the cam follower 128 and cam follower support links 130 out of the over-center position while the tilt mechanism 18 is in the unlocked position (but does not prevent the cam follower 128 and cam follower support links 130 from moving into the over-center position when the tilt mechanism 18 is in the locked position). Keeping the cam follower 128 and cam follower support links 130 out of the over-center position prevents incidental contact between the cam 122 and the cam follower 128 during normal rocking of the seat assembly 14 while the tilt mechanism 18 is in the unlocked position. Preventing such incidental contact eliminates noise that can occur due to incidental rubbing of the cam follower 128 against the cam 122 during normal rocking.

While the furniture member 10 is shown in the figures as a chair having a single seat assembly 14, it will be appreciated that the principles of the present disclosure could be incorporated into a sofa, a love seat, a sectional, or any other type of furniture member having one or more seat assemblies.

While the legrest mechanism 16 is described above as being actuated by the manually driven drive rod 64, in some configurations of the furniture member 10, the drive rod 64 could be driven by an electric motor. In other configurations, the legrest mechanism 16 could be driven by a motor-driven linear actuator.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:
a base frame; and
a seat frame mounted on the base frame;
a seatback mounted to the seat frame;
a seat bottom mounted to the seat frame; and
a legrest mechanism mounted to the seat frame and attached to a legrest platform, the legrest mechanism including a pantograph linkage that is movable relative to the seat frame between a retracted position and an extended position,
wherein the legrest mechanism includes a mid-ottoman bracket non-rotatably attached to a link of the pantograph linkage, the mid-ottoman bracket is disposed between the seat bottom and the legrest platform when the pantograph linkage is in the extended position.

2. The furniture member of claim 1, wherein the mid-ottoman bracket is removably attached to the link of the pantograph linkage with a fastener.

3. The furniture member of claim 2, wherein the pantograph linkage includes a first support link, a swing link, a second support link, a cross link, a third support link, a bracket link, wherein the legrest platform is mounted to the bracket link, and wherein the first support link, the swing link, the second support link, the cross link, and the third support link are flat and free of offsets.

4. The furniture member of claim 3, wherein the first support link and the third support link are in line with each other.

5. The furniture member of claim 4, wherein the swing link, the cross link, and a portion of the bracket link are in line with each other.

6. The furniture member of claim 5, wherein the first support link has a varying width.

7. The furniture member of claim 6, further comprising a front swing link having a first end pivotably coupled to a first bracket fixedly attached to the seat bottom and a second end pivotably coupled to a second bracket fixedly attached to one or both of a front rail plate and a side rail plate of the seat frame.

8. The furniture member of claim 7, wherein the seatback is rotatable relative to the seat bottom between a reclined position and an upright position, wherein rotation of the seatback causes rotation of the front swing link relative to the seat frame, and wherein rotation of the front swing link relative to the seat frame moves the seat bottom relative to the seat frame.

9. The furniture member of claim 1, further comprising a rocker member attached to the seat frame and rollingly contacting the base frame, wherein the rocker member supports the seat frame relative to the base frame such that the seat frame is movable between a rocked-back tilt position and a rocked-forward tilt position.

10. A furniture member comprising:
a base frame; and
a seat frame mounted on the base frame;
a seatback mounted to the seat frame;
a seat bottom mounted to the seat frame; and
a legrest mechanism mounted to the seat frame and attached to a legrest platform, the legrest mechanism including a pantograph linkage that is movable relative to the seat frame between a retracted position and an extended position,
wherein the pantograph linkage includes a first support link, a swing link, a second support link, a cross link, a third support link, a bracket link, wherein the legrest platform is mounted to the bracket link, and wherein the first support link, the swing link, the second support link, the cross link, and the third support link are flat and free of offsets.

11. The furniture member of claim 10, wherein the first support link and the third support link are in line with each other.

12. The furniture member of claim 11, wherein the swing link, the cross link, and a portion of the bracket link are in line with each other.

13. The furniture member of claim 12, wherein the first support link has a varying width.

14. The furniture member of claim 12, wherein the legrest mechanism includes a mid-ottoman bracket non-rotatably attached to the cross link of the pantograph linkage, the mid-ottoman bracket is disposed between the seat bottom and the legrest platform when the pantograph linkage is in the extended position.

15. The furniture member of claim 14, wherein the mid-ottoman bracket is removably attached to the cross link of the pantograph linkage with a fastener.

16. The furniture member of claim 12, further comprising a front swing link having a first end pivotably coupled to a first bracket fixedly attached to the seat bottom and a second end pivotably coupled to a second bracket fixedly attached to one or both of a front rail plate and a side rail plate of the seat frame.

17. The furniture member of claim 16, wherein the seatback is rotatable relative to the seat bottom between a reclined position and an upright position, wherein rotation of the seatback causes rotation of the front swing link relative to the seat frame, and wherein rotation of the front swing link relative to the seat frame moves the seat bottom relative to the seat frame.

18. The furniture member of claim 10, further comprising a rocker member attached to the seat frame and rollingly contacting the base frame, wherein the rocker member supports the seat frame relative to the base frame such that the seat frame is movable between a rocked-back tilt position and a rocked-forward tilt position.

* * * * *